US007757398B2

(12) United States Patent
Hori

(10) Patent No.: US 7,757,398 B2
(45) Date of Patent: Jul. 20, 2010

(54) METHOD OF MANUFACTURING A LIQUID EJECTION HEAD

(75) Inventor: Hisamitsu Hori, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 752 days.

(21) Appl. No.: 11/440,008

(22) Filed: May 25, 2006

(65) Prior Publication Data

US 2006/0268074 A1 Nov. 30, 2006

(30) Foreign Application Priority Data

May 27, 2005 (JP) ..... 2005-156223

(51) Int. Cl.
*B21D 53/76* (2006.01)
*B41J 2/045* (2006.01)

(52) U.S. Cl. ..... 29/890.1; 29/25.35; 427/100; 347/70; 347/71

(58) Field of Classification Search ..... 29/890.1, 29/25.35, 830; 427/100, 240, 425, 427, 427.3, 427/248.1; 310/326, 328; 347/70, 71
See application file for complete search history.

(56) References Cited

U.S. PATENT DOCUMENTS 4,032,928 A * 6/1977 White et al. ..... 347/71
4,338,360 A * 7/1982 Cavanagh et al. ..... 427/427 X
5,406,318 A * 4/1995 Moore et al. ..... 347/70
6,761,028 B2 * 7/2004 Takeuchi et al. ..... 310/328 X
2002/0080215 A1 6/2002 Sakaida et al.
2005/0211162 A1 * 9/2005 Osawa ..... 427/248.1 X

FOREIGN PATENT DOCUMENTS

JP 11348297 A * 12/1999
JP 2000-190535 A 7/2000
JP 2002-166543 A 6/2002
JP 2004-50449 A 2/2004

* cited by examiner

*Primary Examiner*—A. Dexter Tugbang
(74) *Attorney, Agent, or Firm*—Birch, Stewart, Kolasch & Birch, LLP

(57) ABSTRACT

A method of manufacturing a liquid ejection head, includes forming a first substrate into a curved shape so as to form a portion of a substantially cylindrical shape, the first substrate being provided with a liquid flow channel of liquid and a drive wire for supplying a drive signal to a piezoelectric element; forming a second substrate into a curved shape so as to form a portion of a substantially cylindrical shape, the second substrate forming a pressure generating chamber for ejecting the liquid and a diaphragm which forms a surface of the pressure generating chamber; forming the piezoelectric element on the diaphragm at a position corresponding to the pressure generating chamber; forming an ejection port plate on an opposite side across the pressure generating chamber from the diaphragm; and bonding together the first substrate and the second substrate.

8 Claims, 19 Drawing Sheets

METHOD OF MANUFACTURING A LIQUID EJECTION HEAD

BACKGROUND OF THE INVENTION

1. Field of the Invention

The present invention relates to a liquid ejection head and a method of manufacturing same, and more particularly, to a liquid ejection head and a method of manufacturing same, wherein the liquid ejection surface opposing the side face of a rotating drum has a curved shape in the circumferential direction of the rotating drum.

2. Description of the Related Art

As an image forming apparatus, an inkjet printer (inkjet recording apparatus) is known, which comprises an inkjet head (liquid ejection head) having an arrangement of a plurality of nozzles (ejection ports) and which records images on a recording medium by ejecting ink (liquid) from the nozzles toward the recording medium while the inkjet head and the recording medium are caused to be moved relatively to each other.

In an inkjet recording printer, one image is formed on a recording medium by combining dots created by ink ejected from the nozzles. In recent years, it has become desirable to form images of high quality on a par with photographic prints, in inkjet printers. It has been thought that high image quality can be achieved by reducing the size of the ink droplets ejected from the nozzles by reducing the diameter of the nozzles and also increasing the number of pixels per unit surface area by arranging the nozzles at high density. On the other hand, since increasing the density of the nozzles and arranging a large number of nozzles can cause an increase in the size of the apparatus, various methods have been proposed for making the apparatus more compact.

For instance, Japanese Patent Application Publication No. 2002-166543 discloses an inkjet head in which it is sought to make an inkjet head compact in size, by forming ink pressure chambers in an approximately diamond shape, forming ink supply ports in one of the obtuse corner sections of the diamond-shaped pressure chambers, forming an ink spraying nozzle in the other obtuse corner section, arranging the pressure chambers in a plurality of columns, and positioning the pressure chambers in each column in such a manner that the obtuse corner sections on the spray nozzle side are interposed respectively between the pressure chambers in the neighboring column, thereby achieving a high density arrangement of the nozzles.

Furthermore, Japanese Patent Application Publication No. 2000-190535 discloses a recording apparatus having an intermediate transfer body, for instance. An example of the recording apparatus is known in which the image forming apparatus is made compact in size, by holding a recording sheet in a fixed fashion on the surface of a rotating cylindrical tube and providing a plurality of print heads which are movable in the axial direction of the cylinder, in such a manner that an image is formed on the recording sheet by the print heads.

Moreover, for example, Japanese Patent Application Publication No. 2004-50449 discloses a recording apparatus which records images by forming an inverted image by depositing ink droplets on an intermediate transfer body and then transferring the image onto a recording medium. In the recording apparatus, it is sought to improve the quality of the recorded image, by providing a liquid-repelling section in the intermediate transfer body so that aggregation and movement of the each liquid ink droplet on the surface of the intermediate transfer body are suppressed, and by transferring the inverted image formed by the ink droplets deposited on a section of the intermediate transfer body other than the liquid-repelling section, onto the recording medium.

However, the related art technology involves possibilities such as the following. In the case of Japanese Patent Application Publication No. 2002-166543, for example, it is sought to compactify a two-dimensional matrix type head by arranging diamond-shaped pressure chambers at a high density; however, if a matrix head for high-density recording is used in particular, then any rotational deviation of the recording medium due to skewed travel, or the like (namely, inclination of the conveyance direction of the recording medium with respect to the head) is liable to produce deviation in the positions of the ejected droplets, especially at the return sections in the matrix arrangement, since recording is performed while the recording medium is conveyed.

For example, in the case of a high-density inkjet head 950 in which nozzles 951 are arranged in a two-dimensional matrix configuration as shown in FIGS. 20A to 20C, dots 961 are formed on a recording medium 960 by ejecting ink droplets from the nozzles 951 while the recording medium 960 is conveyed relatively with respect to the head.

In this case, if the recording medium 960 is conveyed correctly in a perfectly straight direction with respect to the inkjet head 950, as shown in FIG. 20A, then dots 961 are formed at correct positions on the recording medium 960. However, if the recording medium 960 is conveyed in a skewed fashion, and is inclined toward the left-hand side with respect to the inkjet head 950, as shown in FIG. 20B, then the dot pitch would become narrower and the dots 961 might overlap at the return points of the nozzle columns, as indicated by reference numeral 962 in FIG. 20B, whereas the pitch between the dots 961 would become greater in other positions.

Furthermore, if the recording medium 960 is conveyed in a skewed fashion, and is inclined toward the right-hand side with respect to the inkjet head 950, as shown in FIG. 20C, then the pitch between the dots 961 would become greater at the return points of the nozzle columns, as indicated by reference numeral 964 in FIG. 20C, whereas the pitch between the dots 961 would become narrower in the other positions.

In this way, in an inkjet head in which the nozzles are arranged at high density in a two-dimensional matrix configuration, if the recording medium is conveyed in a skewed fashion, then the positions of the dots formed on the recording medium become disarranged, thus causing band-shaped non-uniformities, and the like, and hence degrading the image quality. In addition to cases where the recording medium is conveyed in a skewed fashion, the same type of possibility might occurs in cases where the inkjet head is installed in an inclined fashion, since this produces a similar positional relationship between the inkjet head and the recording medium. Moreover, in a flat conveyance system, the recording medium is liable to float up, or create projections, variations in thickness, or the like. Therefore, in those cases, it is difficult to reduce the gap between the nozzles and the recording medium, and variation in the landing positions due to deviation in the flight of the droplets can become larger.

Furthermore, the apparatus disclosed in Japanese Patent Application Publication No. 2000-190535, is made compact in size by disposing heads in the circumferential direction of a cylinder; however, this has a structure in which line heads are installed on a curved face-shaped member, and hence it is difficult to apply this type of composition to a matrix type head in which a plurality of nozzles are arranged at high density in a two-dimensional configuration.

Furthermore, Japanese Patent Application Publication No. 2004-50449 seeks to achieve improved image quality by providing a very fine liquid-repelling section on the surface of an intermediate transfer roller; however, in a line type head such as the embodiments illustrated in the publication, semiconductor processing is required and it becomes difficult to achieve a long length and high-speed operation, and in a head composed by joining together a plurality of short heads, non-uniformity density is liable to occur at an area corresponding to a joint section between the heads, and hence such heads are not very suitable for high-quality recording. Moreover, in a matrix type head having a long, single-body structure, since the head is required to have a certain length in the circumferential direction, then the gap between the drum and the nozzles is not uniform if the nozzle surface of the head is a flat surface, and therefore, practical application is difficult.

SUMMARY OF THE INVENTION

The present invention has been contrived in view of the foregoing circumstances, an object thereof being to provide a highly reliable liquid ejection head, and a method of manufacture same, which avoid deviation in the landing positions due to skewed travel of the recording medium, or the like, and which has good characteristics in terms of variation between the nozzles, and accuracy of the landing positions.

In order to attain the aforementioned object, the present invention is directed to a liquid ejection head comprising an ejection port plate provided with a plurality of ejection ports from which liquid is ejected, wherein: the ejection ports are arranged in a two-dimensional matrix configuration; and the ejection port plate has a curved shape so as to form a portion of a substantially cylindrical shape.

According to this aspect of the present invention, the ejection port plate of the liquid ejection head is formed into a curved shape so as to form a portion of a cylindrical side face. Consequently, in the case where an intermediate transfer drum or drum wrap recording is used, it is possible to avoid displacement of the liquid landing positions due to skewed travel of the recording medium, and hence the variation between nozzles and accuracy of the landing positions can be improved. Moreover, by forming the liquid ejection head into the curved shape, the rigidity of the head is improved, and the precision of the shape is stabilized, in respect of warping, twisting, and the like, and therefore, it becomes possible to form a long head.

Preferably, the liquid ejection head further comprises a first substrate provided with piezoelectric elements for generating pressure to eject the liquid from the ejection ports, the first substrate having a curved shape so as to form a portion of a substantially cylindrical shape.

According to this aspect, since the distance from the ejection ports to the piezoelectric element is kept uniform, it is possible to keep the ejection characteristics of the respective ejection ports uniform.

In order to attain the aforementioned object, the present invention is also directed to a method of manufacturing a liquid ejection head, comprising the steps of: forming a first substrate into a curved shape so as to form a portion of a substantially cylindrical shape, the first substrate being provided with a liquid flow channel of liquid and a drive wire for supplying a drive signal to a piezoelectric element; forming a second substrate into a curved shape so as to form a portion of a substantially cylindrical shape, the second substrate forming a pressure generating chamber for ejecting the liquid and a diaphragm which forms a surface of the pressure generating chamber; forming the piezoelectric element on the diaphragm at a position corresponding to the pressure generating chamber; forming an ejection port plate on an opposite side across the pressure generating chamber from the diaphragm; and bonding together the first substrate and the second substrate.

According to this aspect, it is possible to readily manufacture a liquid ejection head in which displacement of the liquid landing positions due to skewed travel of the recording medium, or the like, can be avoided, and variation between nozzles and landing position accuracy can be improved. Furthermore, by forming a curved shape, it is possible to improve the rigidity and precision of shape of the head.

Preferably, the first substrate includes a plurality of third substrates; and at least one pair of the third substrates is formed by diffusion bonding. It is also preferable that the second substrate includes a plurality of fourth substrates; and at least a portion of the fourth substrates is formed by diffusion bonding.

According to these aspects, it is possible to bond together a plurality of plates collectively, in comparison with a case where resin adhesive, or the like, is used. Therefore productivity is improved, the quality of the head is improved in terms of blockage of adhesive, or the like, and the rigidity is improved. Moreover, since the heat resistance is relatively high, then freedom is increased in terms of the processing temperature for the piezoelectric elements and electrical wiring, and when a solid ink is used or when the head is heated during use in order to reduce ink viscosity, then printing quality can be stabilized.

Preferably, at least a portion of the piezoelectric element is formed as a film by an aerosol deposition method. More over, it is preferable that film formation of the piezoelectric element by the aerosol deposition method is performed by rotating aerosol spray nozzles included in a nozzle surface having a curved shape. Alternatively, it is also preferable that film formation of the piezoelectric element by the aerosol deposition method is performed by rotating the second substrate containing the diaphragm.

According to these aspects, it is possible to form a film of the piezoelectric element to a uniform thickness, and hence homogeneity and continuity of characteristics can be ensured.

Preferably, the method further comprises the step of forming an ejection port in the ejection port plate by laser processing after the step of forming the ejection port plate.

According to this aspect, it is possible to form an ejection port having high precision of shape, even in the case of the ejection port plate having a substantially cylindrical shape.

As described above, according to the present invention, the ejection port plate of the liquid ejection head is formed into a curved shape so as to form a portion of a substantially cylindrical shape. Hence, by combining the present invention and an intermediate transfer drum or drum wrap recording, it is possible to avoid displacement of the liquid landing positions due to skewed travel of the recording medium, and the like, and hence the variation between nozzles and accuracy of the landing positions can be improved. Moreover, by forming the liquid ejection head into the curved shape, the rigidity of the head is improved, and the precision of the shape is stabilized, in respect of warping, twisting, and the like, and therefore, it becomes possible to form a long head.

BRIEF DESCRIPTION OF THE DRAWINGS

The nature of this invention, as well as other objects and benefits thereof, will be explained in the following with reference to the accompanying drawings, wherein.

DETAILED DESCRIPTION OF THE PREFERRED EMBODIMENTS

Figure 1:
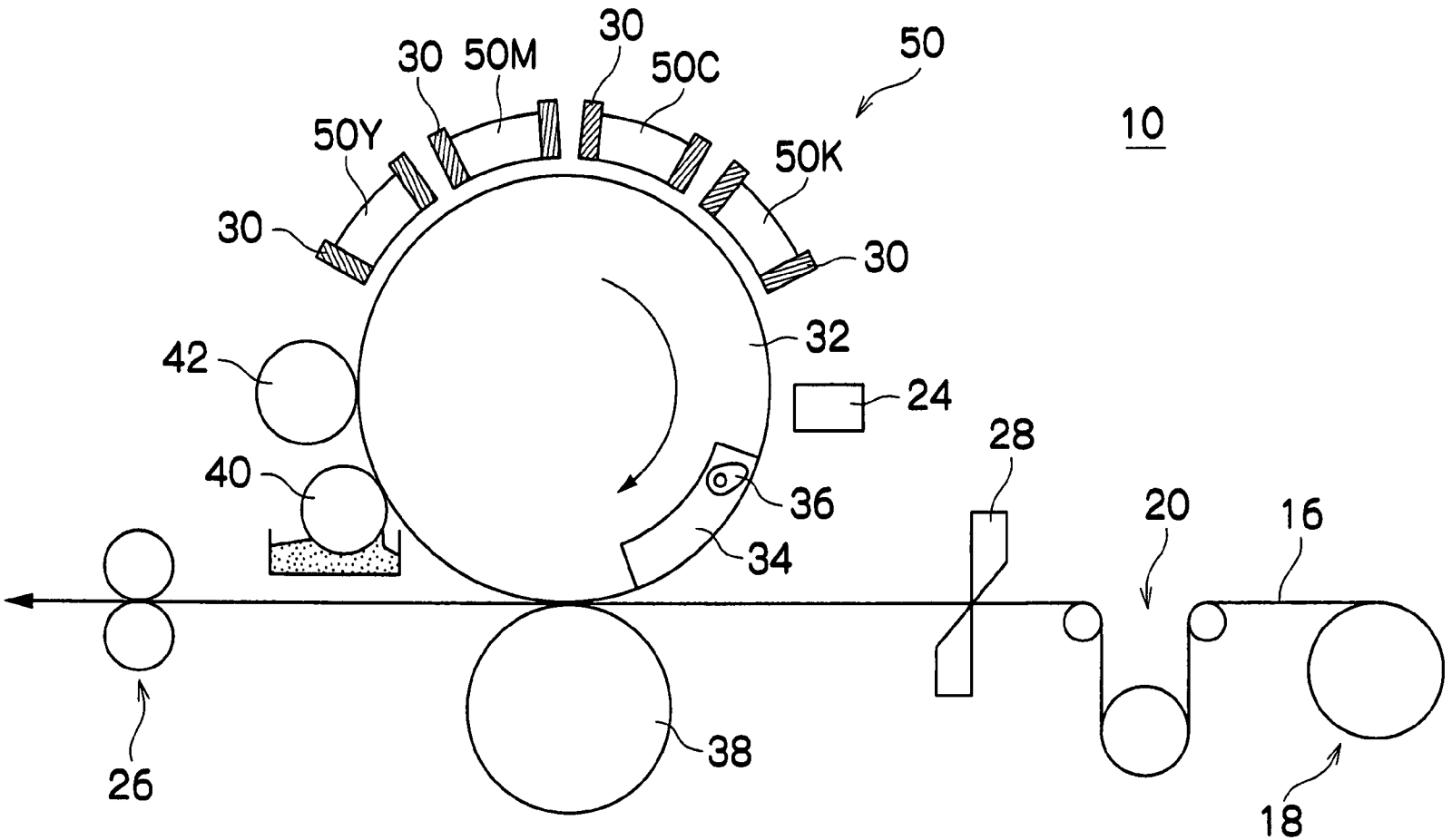
FIG. 1 is a general schematic drawing of an inkjet recording apparatus according to an embodiment of the present invention.

FIG. 1 is a general schematic drawing of an inkjet recording apparatus which forms an image recording apparatus according to one embodiment relating to the present invention.

As shown in FIG. 1, the inkjet recording apparatus 10 according to the present embodiment comprises: a plurality of print heads (liquid ejection heads) 50 (50Y, 50M, 50C, 50K), which eject liquid droplets and are provided respectively for ink colors of yellow (Y), magenta (M), cyan (C) and black (K); an intermediate transfer drum 32 on the surface of which a transfer image is formed; a paper supply unit 18, which supplies recording paper 16 onto which an image is to be recorded by transferring the transfer image from the intermediate transfer drum 32; and a paper output unit 26, which outputs the recording paper 16 after recording.

As shown in FIG. 1, the print heads 50 (50Y, 50M, 50C, 50K) corresponding to the inks of the colors are disposed in the sequence, yellow (Y), magenta (M), cyan (C) and black (K), from the upstream side, following the direction of rotation of the intermediate transfer drum 32 (the direction indicated by the arrow shown in FIG. 1). Furthermore, although the structure of the print heads 50 is described in detail below, each of the print heads 50 is equipped with a cap 30 formed by a elastic or flexible member made of rubber, or the like, so that the side faces of each head are surrounded by the cap 30.

By ejecting inks of the colors from the print heads 50 (50Y, 50M, 50C, 50K) respectively while the intermediate transfer drum 32 is made to rotate, a transfer image is formed on the surface of the intermediate transfer drum 32.

Furthermore, a droplet ejection determination sensor 24 is disposed after the print heads 50, in terms of the direction of rotation of the intermediate transfer drum 32. The droplet ejection determination sensor 24 is a reflection type of sensor which forms a device for reading in the results obtained by ejecting the droplets onto the intermediate transfer drum 32, and checking for nozzle blockages and other ejection defects. Furthermore, a suctioning section 34 for suctioning the ink in the print head 50 during the maintenance of the print head 50, and a wiper 36 which cleans the nozzle surface of the print head 50, are provided in a portion of the side face of the intermediate transfer drum 32. These elements are described in more detail below.

An absorbing roller 40 and an absorbing and removing roller 42 are disposed before the print heads 50, in terms of the direction of rotation of the intermediate transfer drum 32, in order to clean away the soiling on the surface of the intermediate transfer drum 32 after the transfer of the transfer image to the recording paper 16. The absorbing roller 40 contains a cleaning liquid and has liquid absorbing properties. The absorbing roller 40 wets and cleans the surface of the intermediate transfer drum 32, and the absorbing and removing roller 42 absorbs and removes the liquid droplets and foreign matters, such as dirt, from the surface of the intermediate transfer drum 32.

A magazine for rolled paper (a container in which rolled paper is loaded) may be used as an example of the paper supply unit 18 shown in FIG. 1, and a plurality of magazines with papers of different paper width and quality may be jointly provided. Moreover, paper may also be supplied from cassettes which contain cut papers loaded in layers and which are used jointly or in lieu of magazines for rolled papers.

In the present embodiment, a transfer image is formed firstly on the intermediate transfer drum 32, and then is transferred onto the recording paper. Hence, it is possible to use various types of recording paper, and thus the freedom of choice of the recording paper to be used is increased. Moreover, the intermediate transfer drum is provided with a very fine liquid-repelling section, and the non-liquid-repelling section is permeable with respect to the ink solvent, and hence the occurrence of bleeding or stickiness on the recording medium can be reduced by absorbing the liquid from the inner side of the drum.

The recording paper 16 delivered from the paper supply unit 18 may retain curl due to having been loaded in the magazine in the form of rolled paper. In order to remove this curl, a decurling unit 20 is provided after the paper supply unit 18. The decurling unit 20 applies heat to the recording paper 16, by means of a heating drum, in the direction opposite to the direction of the curl induced in the magazine. In this process, the heating temperature is preferably controlled in such a manner that the medium has a curl where the surface on which the print is to be made is slightly rounded in the outward direction.

In a case in which roll paper is used, a cutter 28 is provided after the decurling unit 20 as shown in FIG. 1, and the roll paper is cut to a desired size by the cutter 28. The cut recording paper 16 is conveyed with the print surface facing upwards in the diagram, and the transfer image formed above the intermediate transfer drum 32 is transferred at the transfer position on the conveyance roller 38. When cut paper is used, the cutter 28 is not required.

Each of the print heads 50 (50Y, 50M, 50C, 50K) is a line type head which has a length corresponding to the maximum possible image formation width and is disposed in the axial direction of the intermediate transfer drum 32, the lengthwise direction of the head being a direction substantially perpendicular to the direction of rotation of the intermediate transfer drum 32. Although described in more detail below, a plurality of nozzles are arranged at high density in a two-dimensional matrix configuration on the ink ejection surface (nozzle surface) of each of the heads.

Although a configuration with the four standard colors, K C M and Y, is described in the example shown in FIG. 1, the combinations of the ink colors and the number of colors are not limited to that, and light and/or dark inks can be added as required. For example, a configuration is also possible in which print heads for ejecting light-colored inks such as light cyan and light magenta are added.

Furthermore, although not shown in the drawings, an ink tank storing inks of the colors corresponding to the print heads 50 (50Y, 50M, 50C, 50K) is provided, in such a manner that the inks are supplied to the print heads 50 (50Y, 50M, 50C, 50K) via ink channels (not shown). Moreover, desirably, an ink storing and loading unit (not shown) including ink tanks is provided with a warning device, such as a display device or alarm sound generating device, which generates a warning when the residual amount of ink has become low; and a mechanism for preventing incorrect loading of the wrong-colored ink.

Next, the structure of the print heads 50 (50Y, 50M, 50C, 50K) is described below. The print heads 50 (50Y, 50M, 50C, 50K), each of which is provided for each ink color, have a common structure, and therefore one print head 50 which represents them is described below.

Figure 2A:
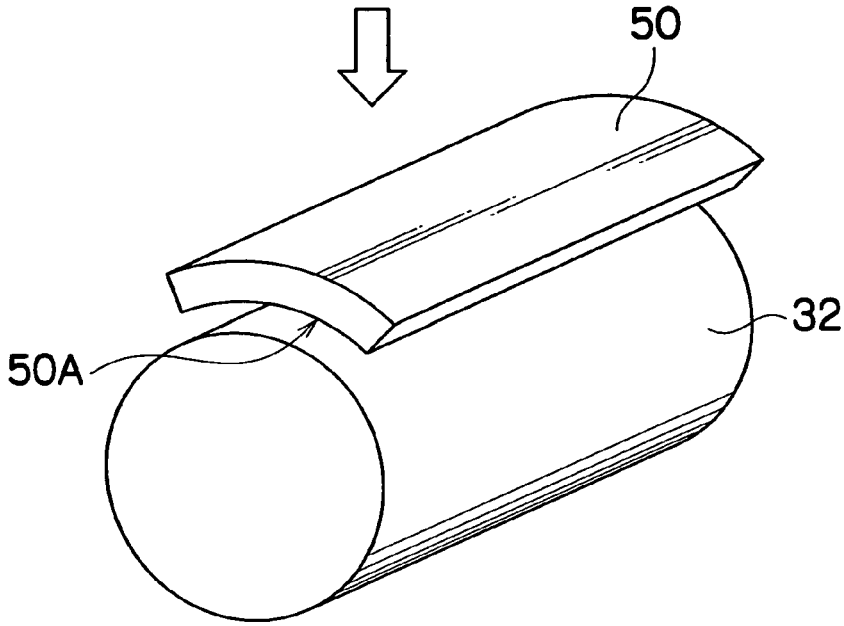
FIG. 2A is a perspective diagram showing the positional relationship between one print head and an intermediate transfer drum.

FIG. 2A is a perspective view showing the positional relationship between one print head 50 and the intermediate transfer drum 32. In FIG. 2A, in order to aid understanding of the general composition of the print head 50, the print head 50 is depicted in an enlarged view, and the ratio of the sizes of the print head 50 and the intermediate transfer drum 32 is not depicted accurately. Furthermore, caps 30 disposed so as to surround the print head 50 are omitted from the drawings.

As shown in FIG. 2A, the print head 50 has a nozzle surface 50A in which a plurality of nozzles for ejecting ink are formed, and the nozzle surface 50A is disposed so as to oppose the side face of the intermediate transfer drum 32. The print head 50 is also aligned so that the lengthwise direction of the head is in parallel with the axial direction of the intermediate transfer drum 32. The nozzle surface 50A has a curved shape in accordance with the curved side surface of the intermediate transfer drum 32, in the breadthways direction of the nozzle surface 50A (the direction along the short side of the nozzle surface 50A).

Figure 2B:
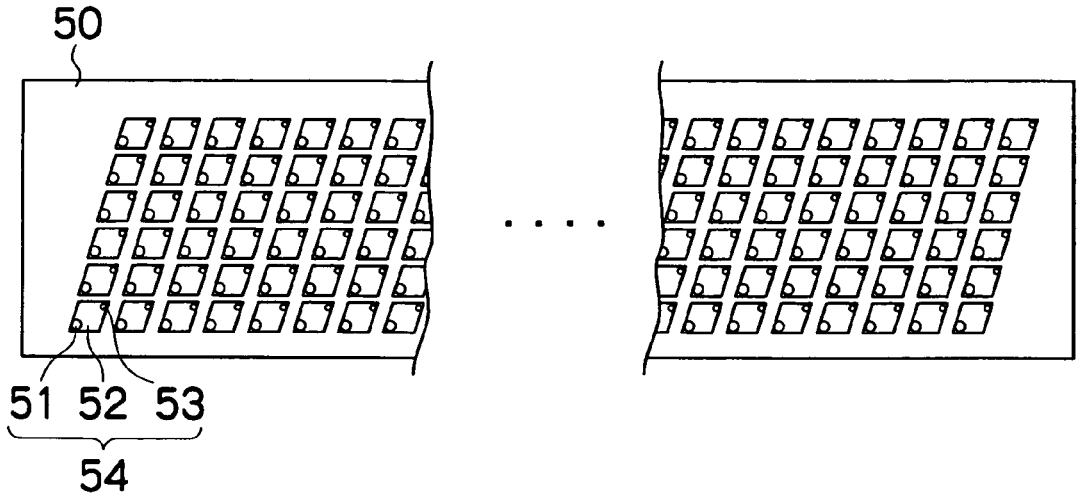
FIG. 2B is a plan view perspective diagram showing the print head in FIG. 2A as viewed in the direction of the arrow in FIG. 2A.

FIG. 2B is a plan view perspective diagram showing the print head 50 in FIG. 2A, as viewed in the direction of the arrow. As shown in FIG. 2B, the print head 50 is designed to achieve a high density arrangement of nozzles 51 by using a two-dimensional staggered matrix array of pressure chamber units 54, each pressure chamber units 54 including a nozzle 51 for ejecting ink as ink droplets, a pressure chamber (pressure generating chamber) 52 for applying pressure to the ink in order to eject ink, and an ink supply port 53 for supplying ink to the pressure chamber 52 from a common flow channel (not shown in FIG. 2B).

In the example shown in FIG. 2B, each of the pressure chambers 52 has a substantial parallelogram shape when viewed from above; however, the planar shape of the pressure chambers 52 is not limited to a parallelogram shape. As shown in FIG. 2B, a nozzle 51 is formed at one end of the diagonal of each pressure chamber 52, and an ink supply port 53 is provided at the other end thereof.

Figure 3:
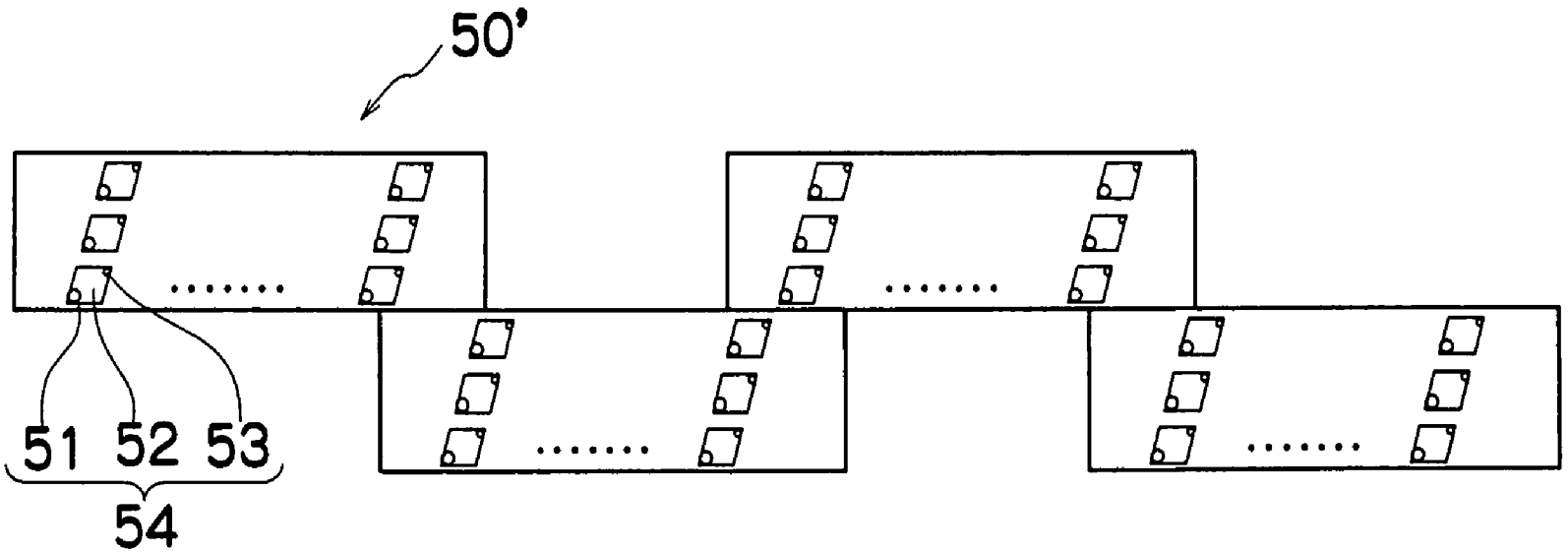
FIG. 3 is a plan view perspective diagram showing a further example of the structure of a print head.

Moreover, FIG. 3 is a plan view perspective diagram showing another example of the structure of the print heads. As shown in FIG. 3, one long full line head may be constituted by combining a plurality of short heads 50' arranged in a two-dimensional staggered array, in such a manner that the combined length of these plurality of short heads 50' corresponds to the full width of the transfer image formation range of the intermediate transfer drum 32.

Figure 4:
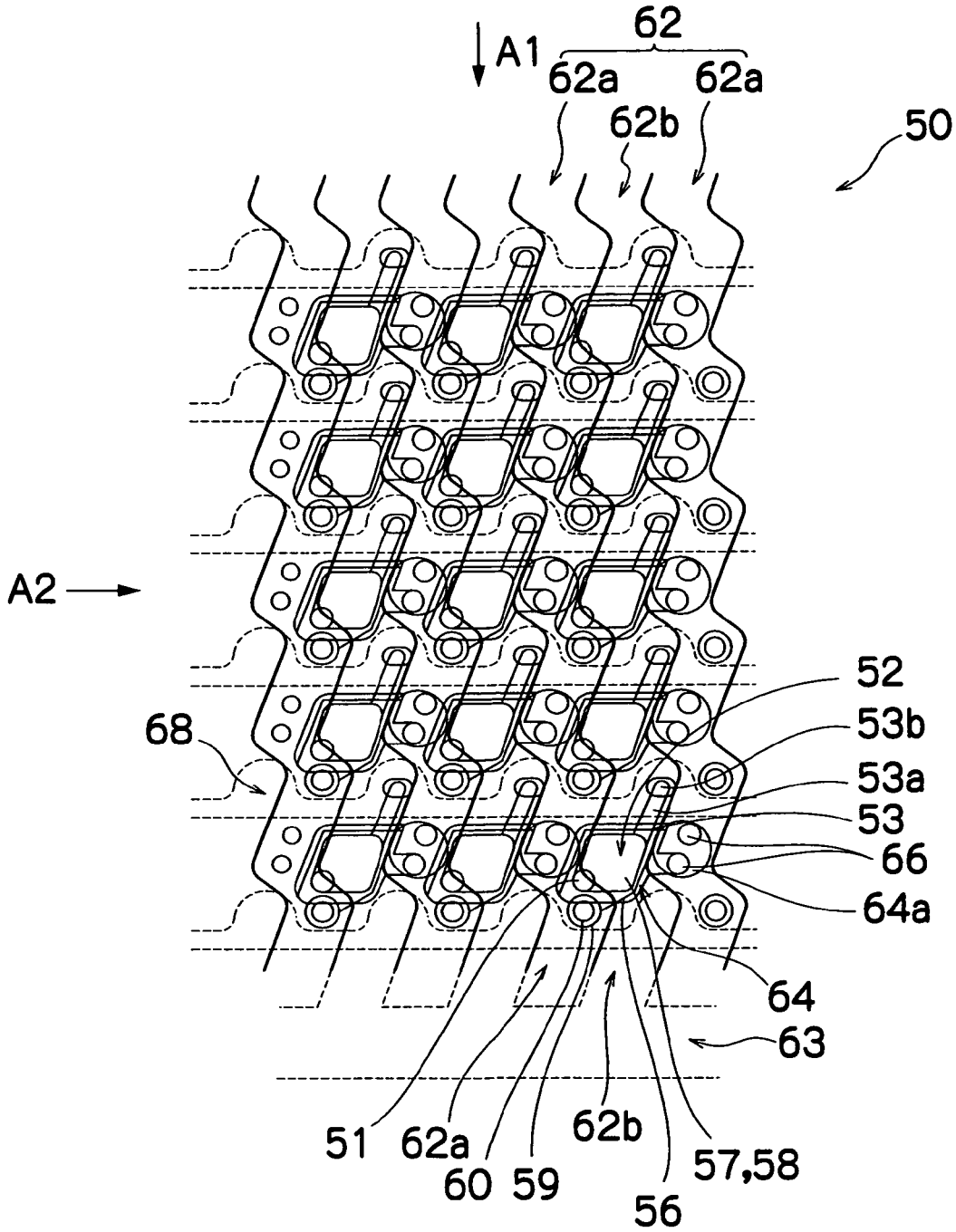
FIG. 4 is a plan view perspective diagram showing a partial enlarged view of a print head according to an embodiment.

FIG. 4 is a plan view perspective diagram showing an enlarged view of a portion of the print head 50 according to the present embodiment.

As described in detail below, the print head 50 according to the present embodiment is laminated from a plurality of plate members.

As described above, the parallelogram-shaped pressure chambers 52, each of which has the nozzle 51 and the supply port 53, are arranged in a staggered two-dimensional matrix fashion in the print head 50. The surface (ceiling) opposing the surface (bottom surface) in which the nozzles 51 of the pressure chambers 52 are formed is constituted by a diaphragm 56 which also serves as a common electrode. Piezoelectric bodies 58 are formed on the diaphragm 56 in accordance with the shape of the pressure chambers 52, and individual electrodes 57 are formed on top of these piezoelectric bodies 58.

A wire is extended to the outer side of each pressure chamber 52, from the end section of the individual electrode 57 on the side adjacent to the nozzle 51, and thereby an electrode pad 59 constituting an electrode connecting section is formed. Column-shaped electrical wires (electrical columns) 60 are formed from these electrode pads 59 so as to rise in a substantially perpendicular direction with respect to the piezoelectric elements 58 (the surface on which the piezoelectric elements 58 are disposed).

Furthermore, in order to form these column-shaped electrical wires 60, a flow channel plate 62, including a plurality of thin band-shaped beam sections 62*a* extending in an undulating form in the vertical direction in FIG. 4 and coupled together at either end (although not shown in the diagram), is arranged. The spaces between the beam sections 62*a* formed by arranging the flow channel plates 62 form tributary channels 62*b* which act as common liquid chambers, namely, common ink supply flow channels for supplying ink to the pressure chambers 52. The partitions of the tributary channels 62*b* as the common liquid chambers are formed by arranging the beam sections 62*a*, and column-shaped electrical wires (electrical columns) 60 are formed so as to pass through these partitions.

Furthermore, ink flow channels 53*a* extend from the ink supply ports 53 formed in one corner of the pressure chambers 52, and supply restrictors 53*b* for receiving ink from the tributary channels 62*b* are formed at the front end of the ink flow channels 53*a*. Although depicted only on the lower side by a broken line in FIG. 4, both ends of the tributary channels 62*b* (the upper and lower ends in the diagram) are connected to main channels 63 of the ink supply flow channels extending in the left-right direction in FIG. 4. Ink is supplied from the ink tank (not shown) to the main channels 63 of the ink supply flow channels, and the ink is supplied from the main channels 63 to the tributary channels 62*b*. Furthermore, ink is supplied from the tributary channels 62*b* to the pressure chambers 52, via the each supply restrictor 53*b* and each ink supply ports 53. The supply restrictor 53*b* and the ink supply port 53 are provided with respect to each pressure chamber 52.

The ink flows from one main channel 63 through the tributary channels 62*b* to another main channel 63, and is then circulated via the ink tank (not shown), thereby promoting the expulsion of air bubbles, stabilizing the viscosity, and achieving cooling of the piezoelectric bodies.

Furthermore, a sensor plate 64 for determining the ink ejection state by determining the pressure inside the pressure chambers 52 is provided below each of the pressure chambers 52, and electrode pads 64*a* are formed outside the pressure chambers 52. Electrical wires (sensor columns) 66 for obtaining determination signals from these pads are erected in a substantially perpendicular direction on the sensor plate 64, similarly to the electrical columns 60 described above.

Although the above-mentioned laminated structure of the print head 50 is described in more detail below, a piezoelectric body cover 68 is disposed over the piezoelectric bodies (generally called "piezo elements") 58, so that the piezoelectric body cover 68 covers the piezoelectric bodies 58 and protects them from the ink. Accordingly, the piezoelectric bodies 58 are separated from the ink, and thereby the driving of the piezoelectric bodies 58 is stabilized. In addition, the damping properties are promoted, and thereby cross-talk is reduced.

Next, the laminated structure of the print head 50 is described with reference to FIGS. 5 and 6.

Figure 5:
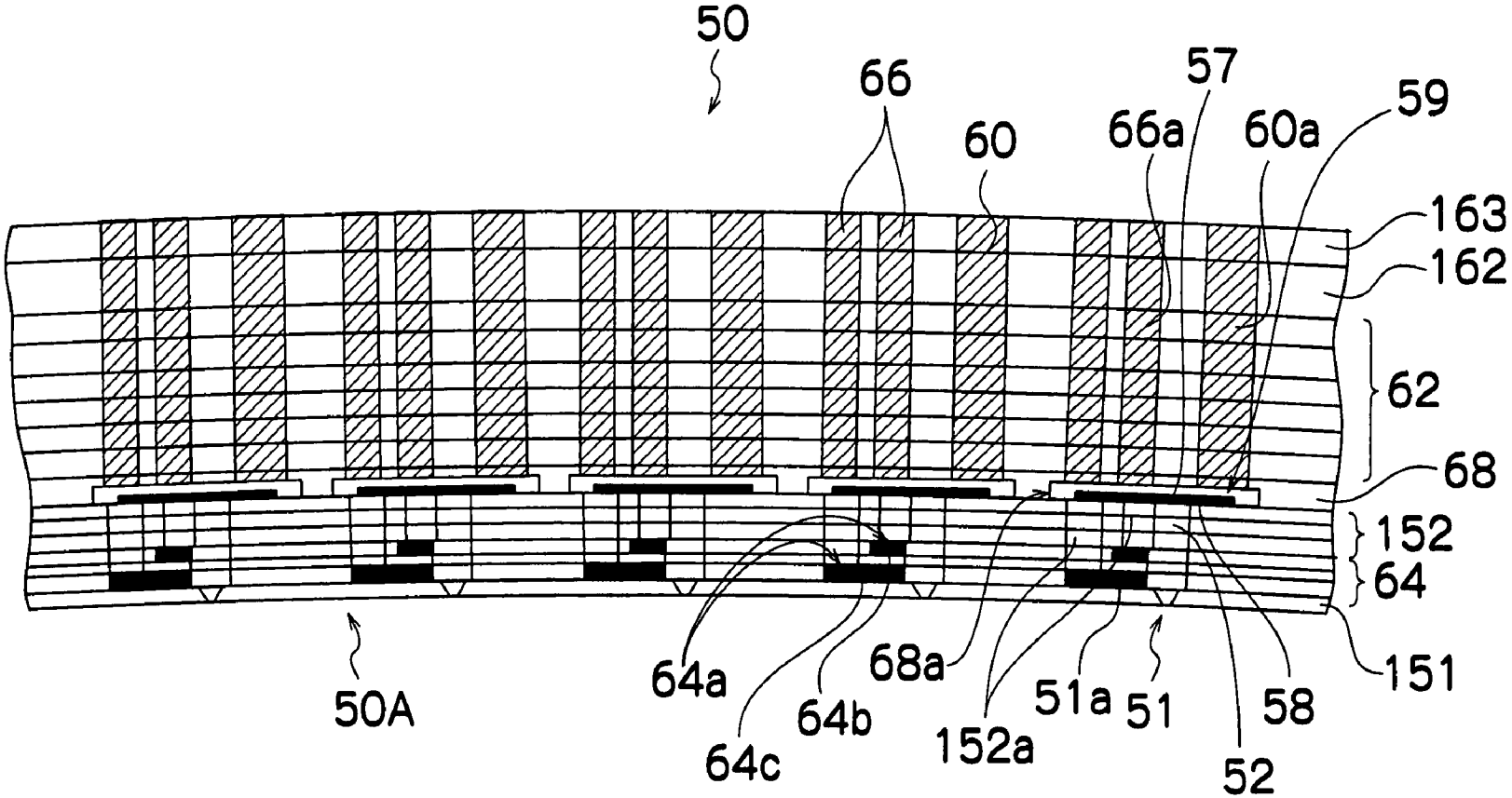
FIG. 5 is a plan view perspective diagram viewed in the direction of arrow A2 in FIG. 4.
Figure 6:
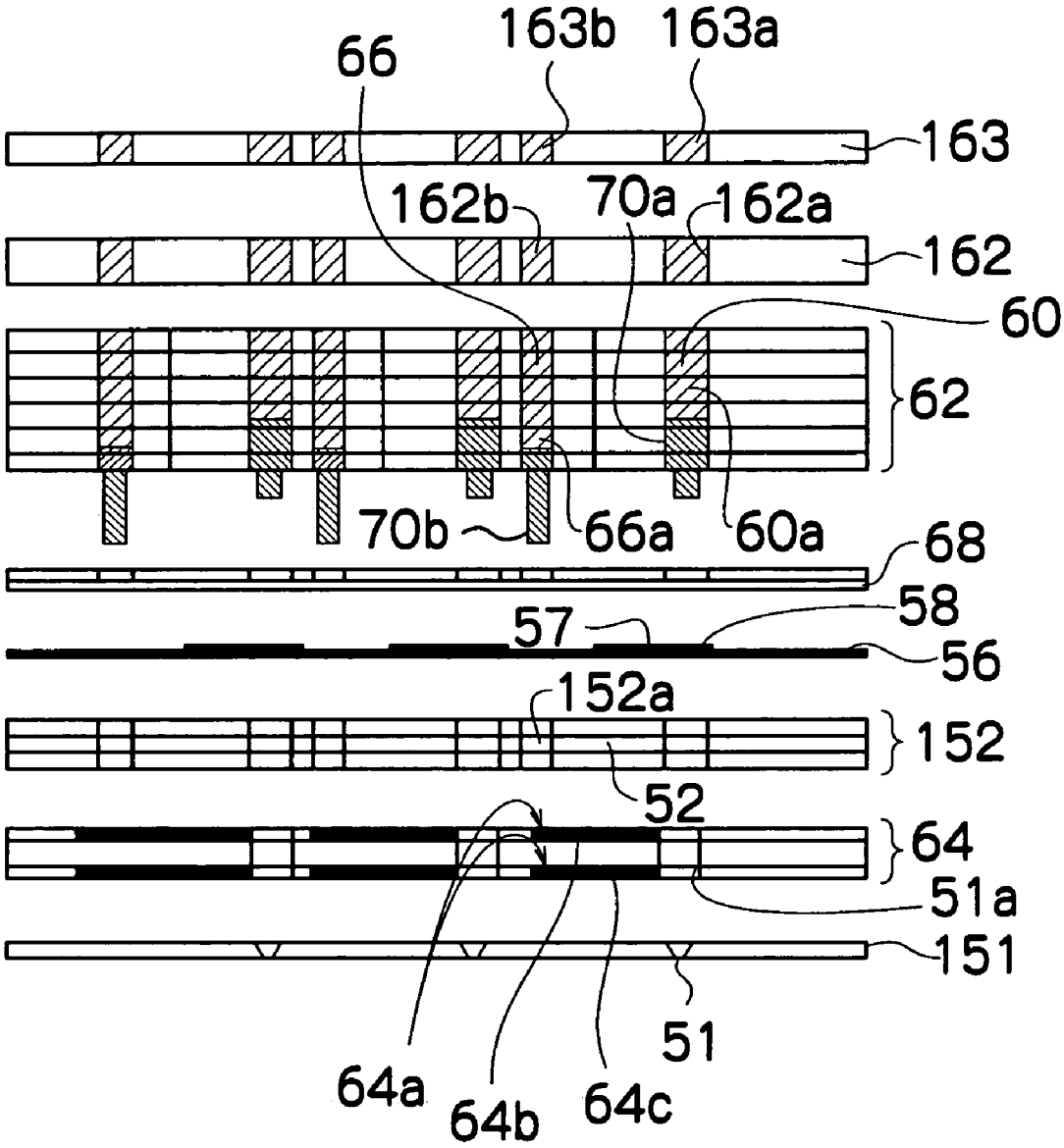
FIG. 6 is an exploded side view perspective diagram viewed in the direction of arrow A1 in FIG. 4.

FIG. 5 is a side view perspective diagram of FIG. 4 as observed in the direction of the arrow A2 in FIG. 4 (on the basis of the side of the print head 50 in the breadthways direction), and FIG. 6 is an exploded side view perspective diagram of FIG. 4 as observed in the direction of the arrow A1 in FIG. 4 (on the basis of the side of the print head 50 in the lengthwise direction). As shown in FIG. 5, in the print head 50, at least the nozzle surface 51A has a curved shape in terms of the breadthways direction, in accordance with the curvature of the circumference of the intermediate transfer drum 32 (see FIG. 2A).

Firstly, a nozzle plate (ejection port plate) 151 formed with nozzles 51 is disposed on the bottommost layer of the print head 50, with reference to FIG. 5 and FIG. 6. The nozzle plate 151 is formed, for example, by half-blanking a stainless steel thin plate in a press, and then grinding, or by processing the plate using an ultra-short-pulse ultraviolet laser, electroforming nickel, subjecting a polyimide sheet to abrasion with an excimer laser, or the like. The plate obtained by one of these techniques is subjected to a liquid-repelling treatment. Furthermore, the nozzles 51 are formed in an inverse tapered shape, in such a manner that they become smaller toward the ink ejection side (the downward direction in the drawings).

Next, a sensor plate 64 for determining the pressure inside the pressure chambers 52 is placed on top of the nozzle plate 151. Nozzle flow channels 51*a* which connect the pressure chambers 52 with the nozzles 51 are formed in the sensor plate 64. For the sensor plate 64, for example, it is possible to preferably use a plate in which PVDF (polyvinylidene fluoride) is placed onto a stainless steel plate. Moreover, electrodes 64*b* and 64*c* are formed on surfaces of the portions of the sensor plate 64 that correspond to the pressure chambers 52. Furthermore, electrode pads 64*a* (see FIG. 4) which are connection sections for the sensor columns 66 that form electrical wires for obtaining the determination signals, are extended respectively from the upper and lower electrodes 64*b* and 64*c* disposed on the front and rear surfaces of the sensor plate 64 across the PVDF. The sensor columns 66 are connected respectively to the electrode pads 64*a* corresponding to the upper and lower electrodes 64*b* and 64*c*, and hence two sensor columns 66 are provided with respect to each pressure chamber 52.

A pressure chamber plate 152 for forming pressure chambers 52 is placed on top of the sensor plate 64. As such a pressure chamber plate 152, it is possible to use a plate formed by stepped etching of a stainless steel plate, or by stacking stainless steel plates which have been etched on both surfaces. Openings which are to form pressure chambers 52 and supply restrictors 53*b*, holes (through holes) 152*a* for sensor columns 66, and bonding material escape grooves (not shown) into which surplus bonding material, such as solder and wax, projects during bonding, thus allowing the bonding material to escape rather than sealing the pressure chambers 52 and the supply restrictors 53*b*, and the like, are formed in the pressure chamber plate 152, according to requirements.

Next, a diaphragm 56 is placed on top of the pressure chamber plate 152. Furthermore, piezoelectric bodies 58 are formed on the diaphragm 56, at positions corresponding to the pressure chambers 52. The piezoelectric bodies 58 may be formed by calcining, sputtering, an AD (aerosol deposition) method, or the like, and the AD method is particularly beneficial in a case where the actuators are formed as a long single body.

Furthermore, although not shown in the drawings, the diaphragm 56 is provided with holes for the supply restrictors 53*b* and holes for the sensor columns 66. Moreover, individual electrodes 57 are formed on the piezoelectric bodies 58, and electrode pads 59 (see FIG. 4) are extended from these individual electrodes 57 on an insulating layer on the diaphragm 56.

Thereupon, the piezoelectric body cover 68 is arranged on the diaphragm 56 on which the piezoelectric bodies 58 have been formed. The piezoelectric body cover 68 has, for example, a half-blanked structure, in which a stainless steel thin plate is subjected to wet etching, and in particular, the sections 68*a* corresponding to the positions of the piezoelectric bodies 58 are half-etched, in such a manner that it avoids the piezoelectric bodies 58 when it is arranged. Furthermore, although not shown in the drawings, the piezoelectric body cover 68 is provided with holes for supply ports 53, holes for the electrical columns 60, and holes for the sensor columns 66.

In order to cover the piezoelectric bodies 58 and protect them from the ink; in order to stabilize the driving of the piezoelectric bodies 58 by separating them from the ink; and in order to reduce cross-talk by imparting damping properties, the sections 68*a* of the piezoelectric body 68 corresponding to the positions of the piezoelectric bodies 58 are half-etched, as described above.

Cavity sections for the electrical columns 60 and cavity sections for the sensor columns 66, which are column-shaped electrical wires, are formed on the piezoelectric body cover 68. Furthermore, the flow channel plate 62 which forms spaces for the tributary channels 62*b* of the ink supply flow channel is arranged thereon. The flow channel plate 62 is formed by a stainless steel thin plate subjected to wet etching, for example. As shown in FIG. 4, the flow channel plate 62 is composed as a single plate by combining a plurality of the long undulating beam sections 62*a* (not shown), and the spaces between the beam sections 62*a* are formed so as to become the tributary channels 62*b* (a common liquid chamber). Consequently, the common liquid chamber is formed on the opposite side of the pressure chambers 52 from the nozzles 51.

Holes 60*a* for electrical columns 60 and holes 66*a* for sensor columns 66 are formed in the bridge sections 62*a* in the flow channel plate 62. As shown in particular in FIG. 6 and described in more detail below, a plate member 70*a* which is to form an electrical column 60 is inserted into each of the holes 60*a*, and a plate member 70*b* which is to form a sensor column 66 is inserted into each of the holes 66*a*.

A plate 162 for sealing the main channels 63 and the tributary channels 62*b* is arranged on the flow channel plate 62, and furthermore, a plate 163 for sealing the main channel 63 is arranged on top of this plate 162. The plate 163 for sealing the main channels 63 may also serve as a heater for controlling the temperature of the whole of the lamination plates. Furthermore, as shown in FIG. 6, holes 162*a* and 163*a* for the electrical columns 60 and holes 162*b* and 163*b* for the sensor columns 66 are formed respectively in these plates 162 and 163.

The print head 50 has the laminated structure as described above. As described hereinafter, an electrical substrate including a multiple-layer flexible cable which has a bump and is mounted with a driver IC, or the like, is bonded on the laminated structure.

In this way, the print head 50 according to the present embodiment is laminated from various plate members in the form of a thin plate.

Figure 7:
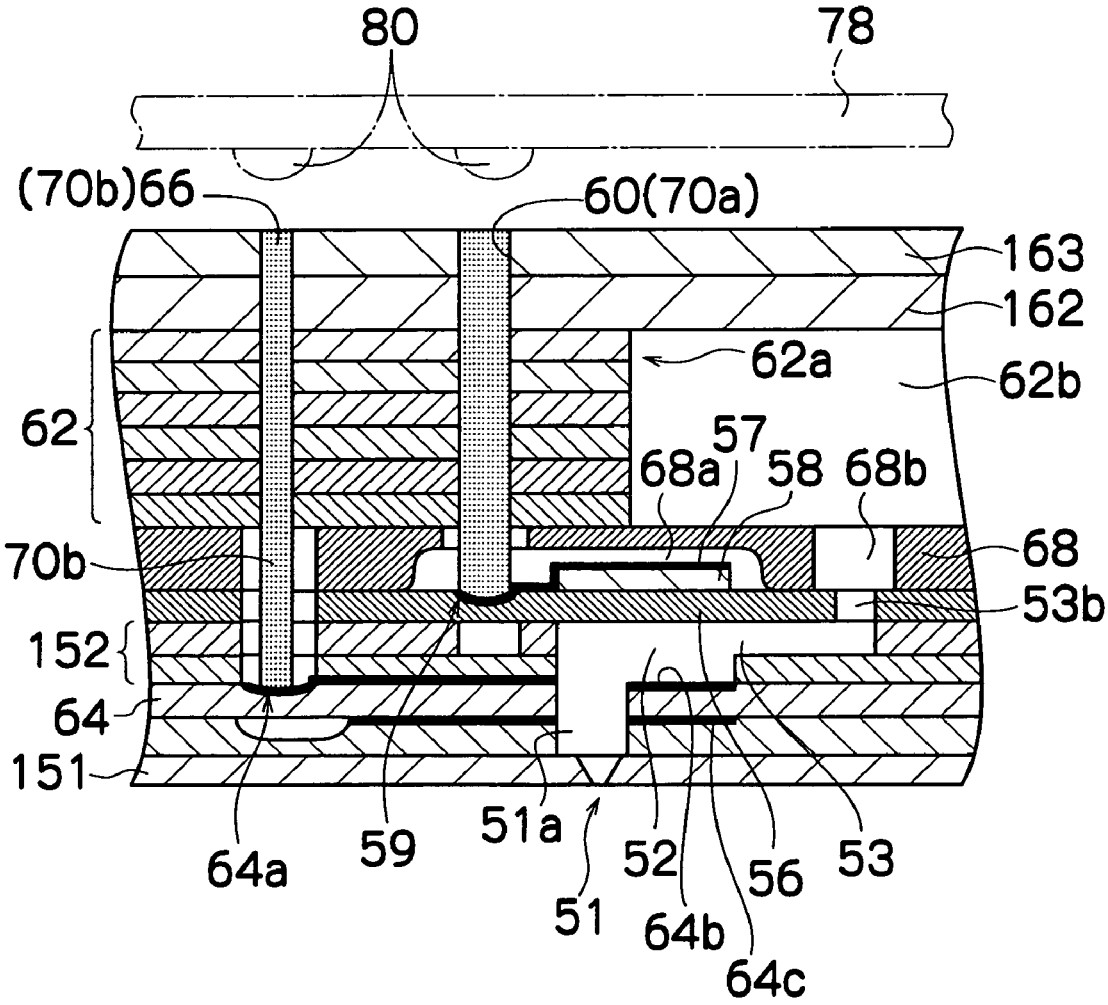
FIG. 7 is a cross-sectional diagram showing an enlarged view of the vicinity of one pressure chamber in the print head.

FIG. 7 shows an enlarged sectional view of the vicinity of one pressure chamber 52 in the print head 50 formed in this way.

As shown in FIG. 7, the pressure chambers 52 in the print head 50 are respectively connected to the nozzles 51 via the nozzle flow channels 51*a*, and are respectively connected to the tributary channels 62*b* forming the common liquid chambers, which supplies ink to the pressure chambers 52, via the ink supply ports 53, the ink flow channels 53*a* and the supply restrictors 53*b*.

Furthermore, the upper surface of the pressure chambers 52 is formed by the diaphragm 56, the piezoelectric bodies 58 are disposed on the diaphragm 56, and the piezoelectric body cover 68 is formed over the piezoelectric bodies 58. Below the pressure chambers 52, the sensor plate 64 is provided in order to form the sensor for determining the ink pressure generated inside each of the pressure chambers 52.

Furthermore, the electrical wires (electrical columns) 60 for supplying drive signals to the piezoelectric bodies 58 are formed by plate members 70*a*, and the electrical wires (sensor columns) 66 which transmit the determination signals from the sensor plate 64 are formed by plate members 70*b*. The electrical columns 60 are connected electrically to the electrode pads 59 which are extended from the individual electrodes 57 on the piezoelectric bodies 58, and are formed so as to rise up perpendicularly with respect to the surface on which the piezoelectric bodies 58 are formed. The sensor columns 66 are connected electrically to the electrode pads 64*a* which are extended from the electrodes 64*b* and 64*c* formed on the upper and lower surfaces of the sensor plate 64, and are formed so as to rise up perpendicularly with respect to the surface on which the sensor plate 64 is formed. The electrical columns 60 and the sensor columns 66 pass through the bridge sections 62*a* which form the side walls of the tributary channels 62*b*.

Moreover, a multi-layer flexible cable 78 is wired on top of the plates 162 and 163 which form the upper surface of the tributary channels 62*b*, and this cable 78 is connected electrically to the electrical columns 60 and the sensor columns 66 by means of electrodes (bumps) 80, 80. In FIG. 7, only the sensor columns 66 formed on the electrode pads 64*a* extended from the electrodes 64*b* on the upper side of the sensor plate 64 are depicted.

Next, the cap 30 is described. As described previously, the cap 30 is installed on each print head 50 in such a manner that it makes contact with the side faces of the print head 50 and surrounds the perimeter of the head.

Figure 8A:
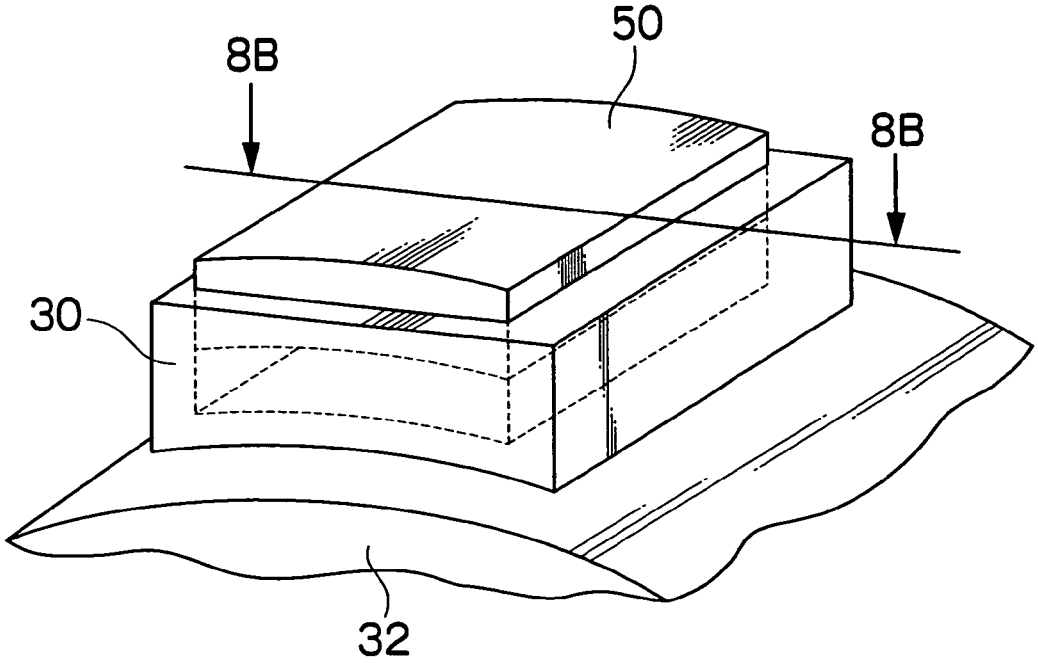
FIG. 8A is a perspective diagram showing a state where a cap has been attached to the print head.
Figure 8B:
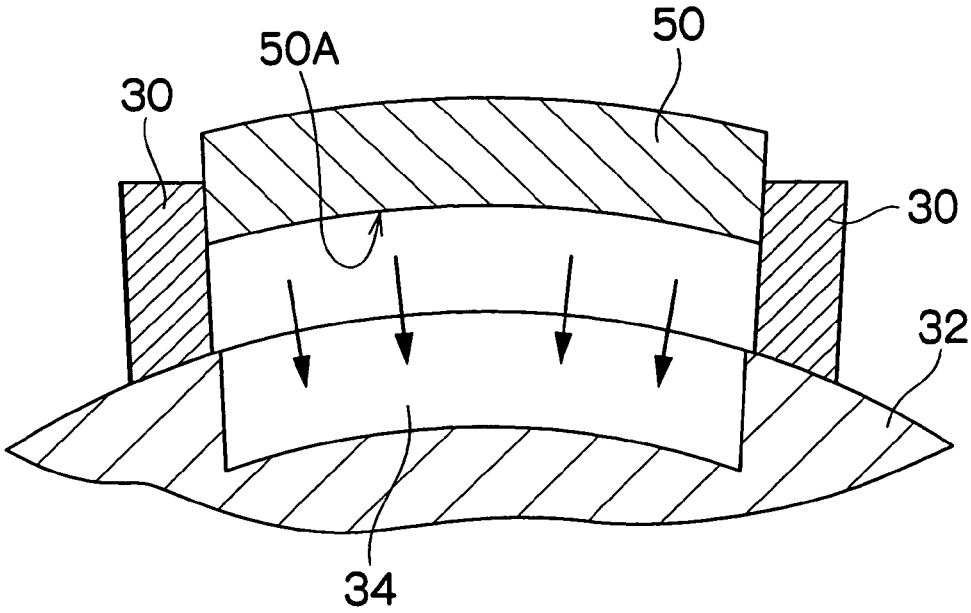
FIG. 8B is a cross-sectional diagram along line 8B-8B in FIG. 8A.

FIG. 8A is a perspective diagram showing a state where the cap 30 is installed on each print head 50, and FIG. 8B shows a cross-sectional diagram along line 8B-8B in FIG. 8A.

As shown in FIG. 8A, the cap 30 is a quadrilateral frame-shaped member which surrounds the perimeter of the print head 50, and it is disposed movably in the vertical direction along the side faces of the print head 50 as it makes close contact with the side faces of the print head 50. In absorbing ink, the intermediate transfer drum 32 is rotated until the suctioning section 34 provided on the side face of the intermediate transfer drum 32 comes to a position below the print head 50, and the cap 30 is moved downward in such a manner that the lower part of the cap 30 makes close contact with the side face of the intermediate transfer drum 32.

Hence, the lower part of the cap 30 is formed with a curved shape in accordance with the curvature of the side face of the intermediate transfer drum 32, in the direction of rotation of the intermediate transfer drum 32. In this way, since the cap 30 needs to make close contact with the side faces of the print head 50 and the side face (circumferential surface) of the intermediate transfer drum 32 during suctioning of the ink, it is made of an elastic and/or flexible member, such as rubber.

FIG. 8B shows a state where ink is being suctioned. As shown in FIG. 8B, in suctioning ink, the cap 30 is moved downward (toward the side face of the intermediate transfer drum 32), and the lower part of the cap 30 makes close contact with the side face of the intermediate transfer drum 32. Thereby, the suctioning section 34 is positioned in the space created by the cap 30, and the space between the suctioning section 34 and the nozzle surface 50A of the print head 50 is sealed off. In this state, a pump (not shown) which is connected to the suctioning section 34 is driven, and thereby the ink inside the print head 50 is suctioned and led into the suctioning section 34.

Figure 9A:
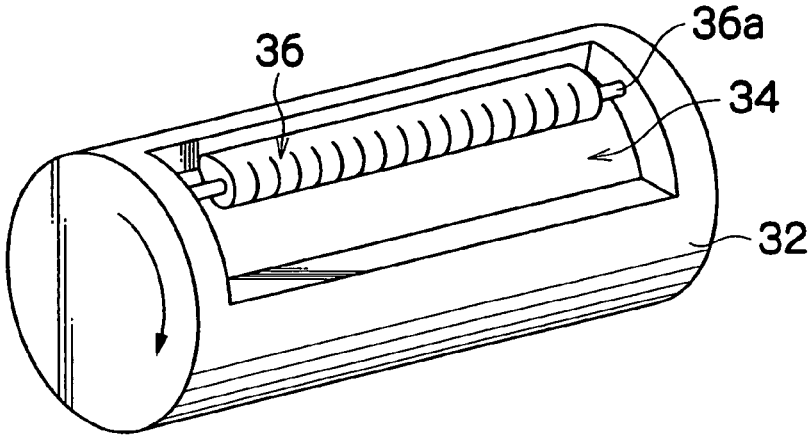
FIG. 9A is a perspective diagram showing a wiper.

Next, the wiper 36 is described. FIG. 9A shows an oblique diagram of the wiper 36 provided on the intermediate transfer drum 32.

In the example shown in FIG. 9A, the wiper 36 has a length corresponding to the length in the lengthwise direction of the print head 50 (not shown), in the axial direction of the intermediate transfer drum 32. The wiper 36 is disposed inside the suctioning section 34, rotatably around an axle 36*a*.

Figure 9B:
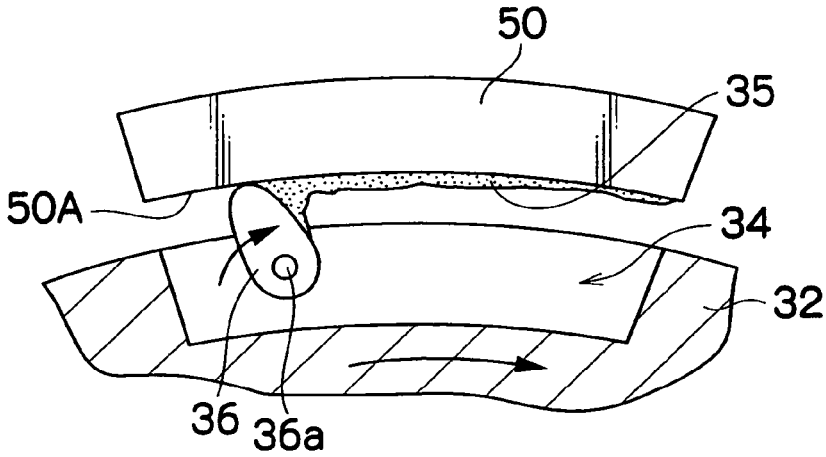
FIG. 9B is a cross-sectional diagram of same.

FIG. 9B is a side sectional view showing a situation where the wiper 36 is driven (during a wiping operation). As shown in FIG. 9B, the wiper 36 has, for example, an egg-shaped cross-section, and the axle 36*a* is disposed on the side of one end of this cross-section. During the wiping, the wiper 36 is rotated around the axle 36*a* in the direction indicated by the arrow in the diagram, and the other end of the wiper 36 abuts against the nozzle surface 50A of the print head 50. With the rotation of the intermediate transfer drum 32 in the direction indicated by the arrow in FIG. 9B, matters such as the ink 35 adhering to the nozzle surface 50A are wiped off.

In order to improve the close contact between the wiper 36 and the nozzle surface 50A in such a manner that the wiper 36 moves to wipe off the ink 35 while the wiper 36 contacts with the nozzle surface 50A of the print head 50 in this way, desirably, at least the portion of the wiper 36 which makes contact with the nozzle surface 50A is made of an elastic member, such as rubber.

Figure 9C:
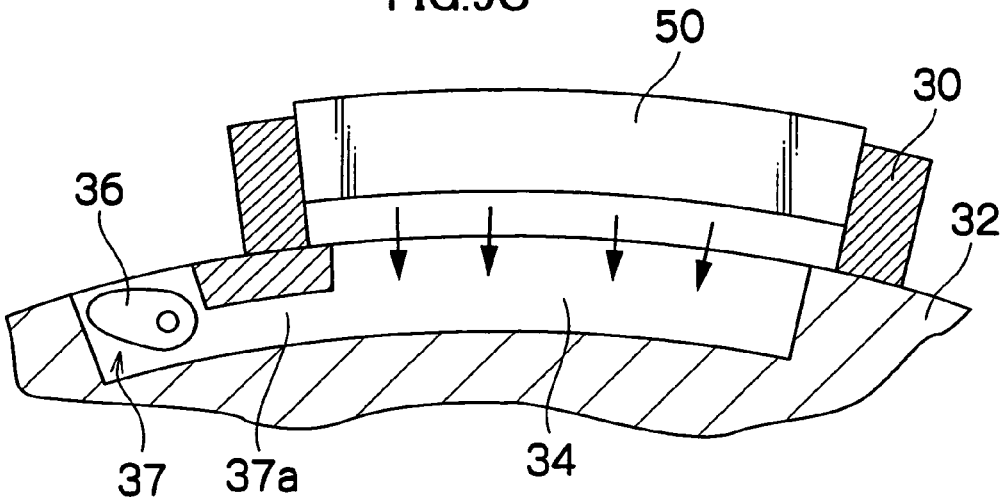
FIG. 9C is a cross-sectional diagram showing another wiper.

The installation position of the wiper 36 is not limited to being inside the suctioning section 34 in this fashion. If installing the wiper 36 inside the suctioning section 34 causes an obstruction to the ink suctioning operation, then as shown in FIG. 9C, it is possible to provide a special gap section 37 for disposing the wiper 36, separately from the suctioning section 34. In this case, desirably, a channel 37*a* is provided which connects the gap section 37 with the suctioning section 34, in such a manner that the ink wiped off by the wiper 36 and falling down into the gap section 37 can flow into the suctioning section 34 and be gathered.

Figure 10:
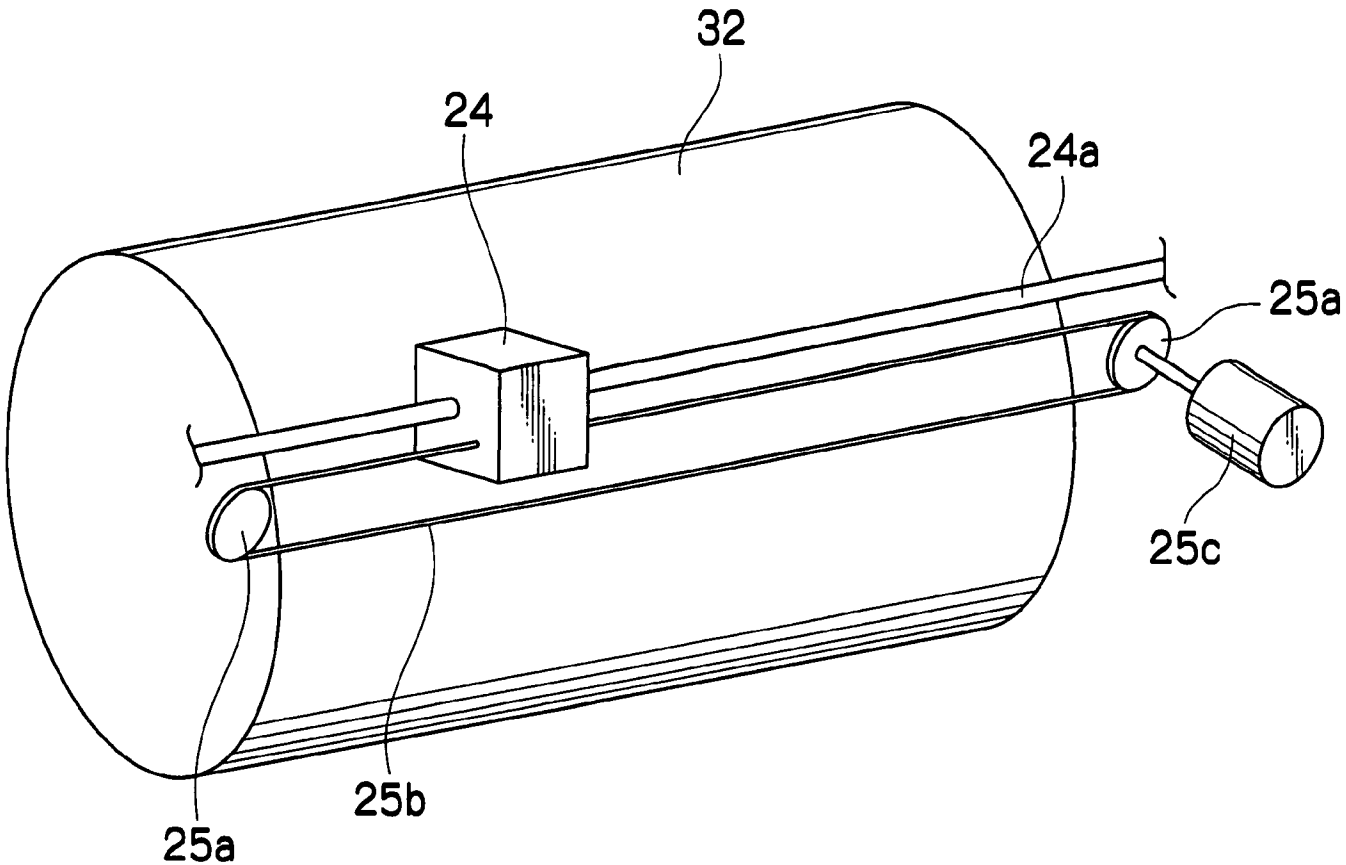
FIG. 10 is a perspective diagram showing a droplet ejection determination sensor.

Next, the droplet ejection determination sensor 24 is described. FIG. 10 shows an oblique diagram of the droplet ejection determination sensor 24 provided with the intermediate transfer drum 32.

As shown in FIG. 10, the droplet ejection determination sensor 24 is, for example, a reflective-type sensor, and is provided movably along a guide 24*a* disposed in parallel with the axis of the intermediate transfer drum 32. Furthermore, the droplet ejection determination sensor 24 is fixed to a timing belt 25*b* which is wound between two pulleys 25*a* and 25*a*, and it determines the liquid ink droplets ejected onto the side face (surface) of the intermediate transfer drum 32 while being moved along the side face in parallel with the axial direction of the intermediate transfer drum 32, by means of a motor 25*c* connected to one 25*a* of the pulleys.

In the case of a sensor which determines droplet ejection by scanning over the surface of the intermediate transfer drum 32 in the axial direction as shown in FIG. 10, in conducting the determination, the intermediate transfer drum 32 is rotated until the droplet ejection position that is to be determined reaches the position of the droplet ejection sensor 24, and the intermediate transfer drum 32 is halted at that position, and then the droplet ejection determination sensor 24 conducts the determination by scanning.

If the droplet ejection determination sensor 24 is a line type sensor which covers the full droplet ejection range of the print head 50, then it is possible to carry out the determination while the intermediate transfer drum 32 is rotated.

Furthermore, by providing the movable wiper 36 and the suctioning section 34 in the intermediate transfer drum 32 in this way, and by providing the movable cap 30 on each of the print heads 50, it is possible to improve the reliability and reduce the size of the apparatus.

Next, the image forming method used in the image forming apparatus having the composition described above according to the present embodiment is explained. Firstly, recording paper 16 supplied from the paper supply unit 18 is cut to a prescribed size by the cutter 28, and it is then conveyed to the conveyance roller 38.

On the other hand, in a print controller (not shown in the drawings), prescribed signal processing is carried out on the basis of image data supplied by a host computer, and the ejection volumes and ejection timings of the liquid ink droplets from the print heads 50 (50Y, 50M, 50C, 50K) are controlled in such a manner that a transfer image (an inverted image for being transferred to the recording paper 16) is formed on the intermediate transfer drum 32.

The transfer image formed on the intermediate transfer drum 32 is transferred to the recording paper 16 at the position of the conveyance roller 38, thereby forming an image on the recording paper 16. The recording paper 16 on which the image has been formed is output from the paper output unit 26.

Next, a method of manufacturing the print head 50 in which nozzles are arranged in a two-dimensional matrix fashion on the curved nozzle surface of this kind, is explained.

Figure 11:
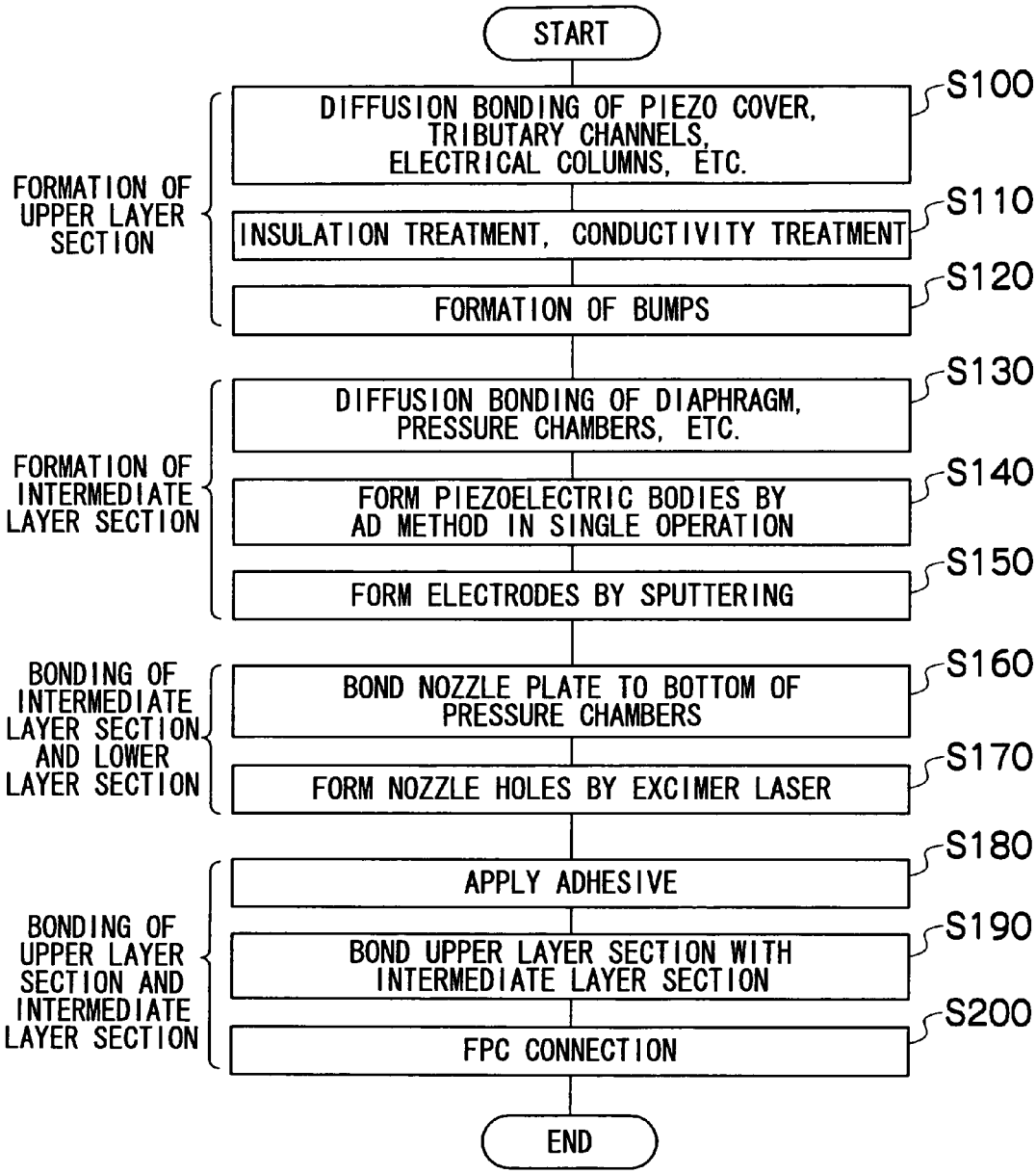
FIG. 11 is a flowchart describing a method of manufacturing a print head according to an embodiment.

FIG. 11 shows a flowchart indicating a method of manufacturing the print head 50 according to the present embodiment.

Firstly, an upper layer section constituting the upper side of the print head 50 with respect to the piezoelectric bodies 58 is formed. In other words, firstly, at step S100 in FIG. 11, various plates forming the upper layer section of the print head 50, such as a piezoelectric body cover 68, a flow channel plate 62 having bridge sections 62*a* for forming tributary channels 62*b* and electrical columns 60, sealing plates (plates 162 and 163) formed with main channels 63 of the ink flow channel, for sealing the whole ink flow channel, and the like, are mutually superimposed and bonded together by diffusion bonding.

Figure 12:
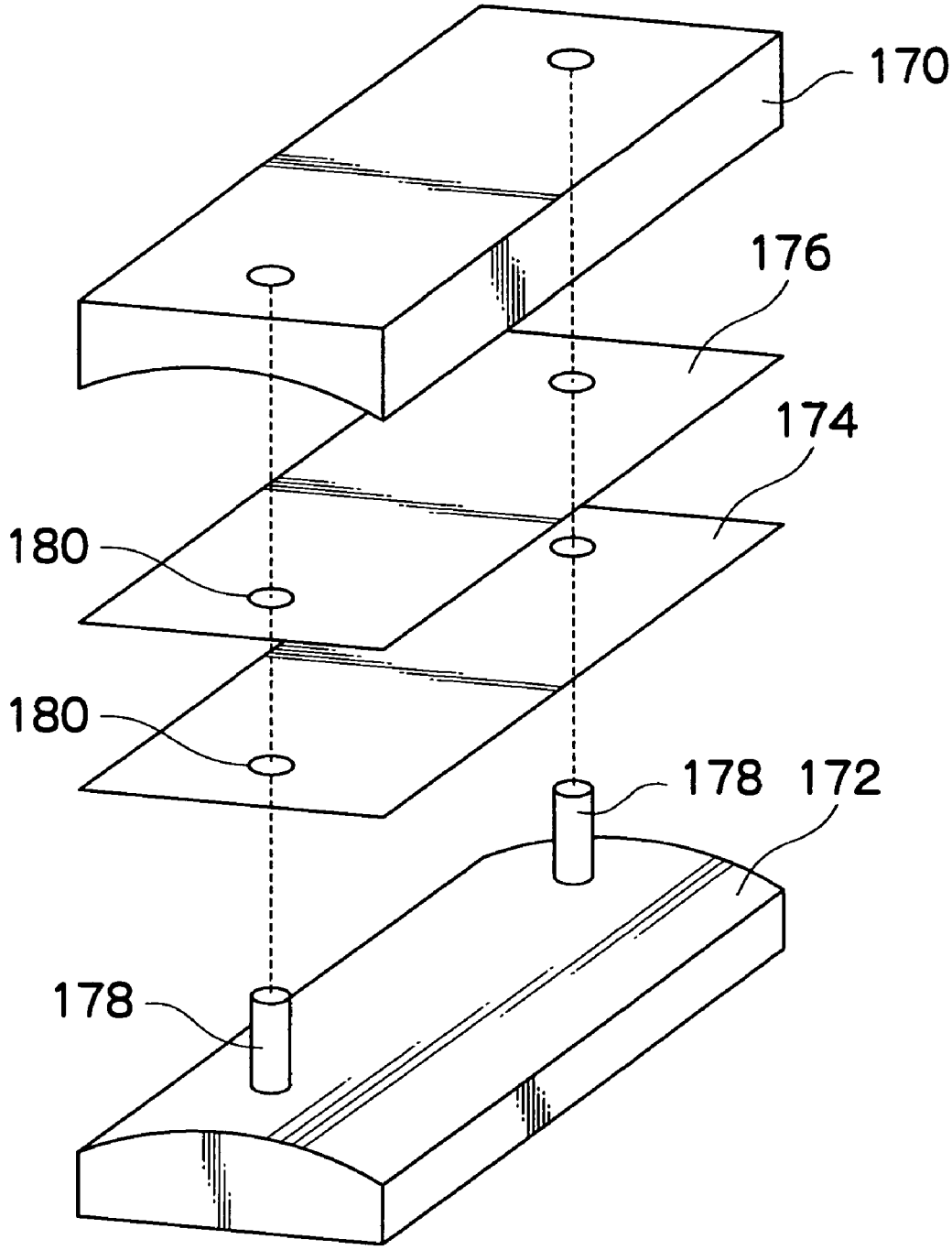
FIG. 12 is an illustrative diagram showing diffusion bonding of laminated plates.

FIG. 12 shows an oblique view of a state of the diffusion bonding. The diffusion bonding is a technique in which heat and pressure are applied to metal plates, thereby creating bonds between the metal atoms and thus bonding the metals together in the solid phase. For example, as shown in FIG. 12, the positioning holes 180 of the plates 174 and 176 are aligned with positioning pins 178 on a convex curved jig 172, the plates 174 and 176 are then sandwiched between this convex curved jig 172 and a concave curved jig 170, and heat and pressure are applied, thereby bonding the plates together. A diffusion bonding technique such as hot pressing, or HIP (Hot Isostatic Pressing, Hot Isotropic Heating), or the like, can be used. In order to reduce the bonding pressure and to stabilize the bonding quality, it is possible to use a liquid-phase diffusion bonding method, by forming a metal plating of nickel, or the like, onto the plates.

In the example shown in FIG. 12, pressure is applied after sandwiching the flat plane-shaped plates 174 and 176 between the concave curved jig 170 and the convex curved jig 172; however, it is also possible to form the plates 174 and 176 into a curved shaped in a press, before sandwiching them between the jigs.

By forming laminated plates in a curved shape by diffusion bonding in this way, it is possible to increase the rigidity and thermal resistance compared to resin bonding of a flat planar shape, and therefore accuracy can be improved, with respect to warping, or the like.

In the next step, S110, insulation treatment (electrocoating) and/or conductivity treatment (electroless plating) are performed in the necessary portions of the upper layer section thus formed. In other words, the insulation treatment is applied to the sections of the piezoelectric body cover 68, the flow channel plate 62, the plates 162, 163, and the like, which can make contact with the ink. The conductivity treatment is applied to the inside of the holes 60*a* and 66*a* where the electrical columns 60 and the sensor columns 66 are to be formed in the flow channel plate 62.

In the next step, S120, (electrical) bumps are formed on sections where the electrodes for connecting with the electrical wires are formed. For example, the bumps are formed in the connection sections between the electrical columns 60 in the flow channel plate 62 and the multi-layer flexible printed circuit (FPC), and between the sensor columns 66 in the flow channel plate 62 and the multi-layer flexible printed circuit (FPC).

In this way, the upper layer portion of the print head 50 above the piezoelectric bodies 58 is formed.

After that, the intermediate layer section of the print head 50 constituted by the pressure chambers 52, diaphragm 56 and piezoelectric bodies 58 is formed.

Firstly, at step S130, plates including the diaphragm 56 and the pressure chamber plate 152 forming the pressure chambers 52, are bonded by diffusion bonding, similarly to step S100 described above.

In the next step, S140, piezoelectric bodies 58 are formed on the diaphragm 56 which has been bonded with the pressure chamber plate 152. The piezoelectric bodies 58 are formed jointly by creating films on the diaphragm 56 at a time by the aerosol deposition method.

Figure 13:
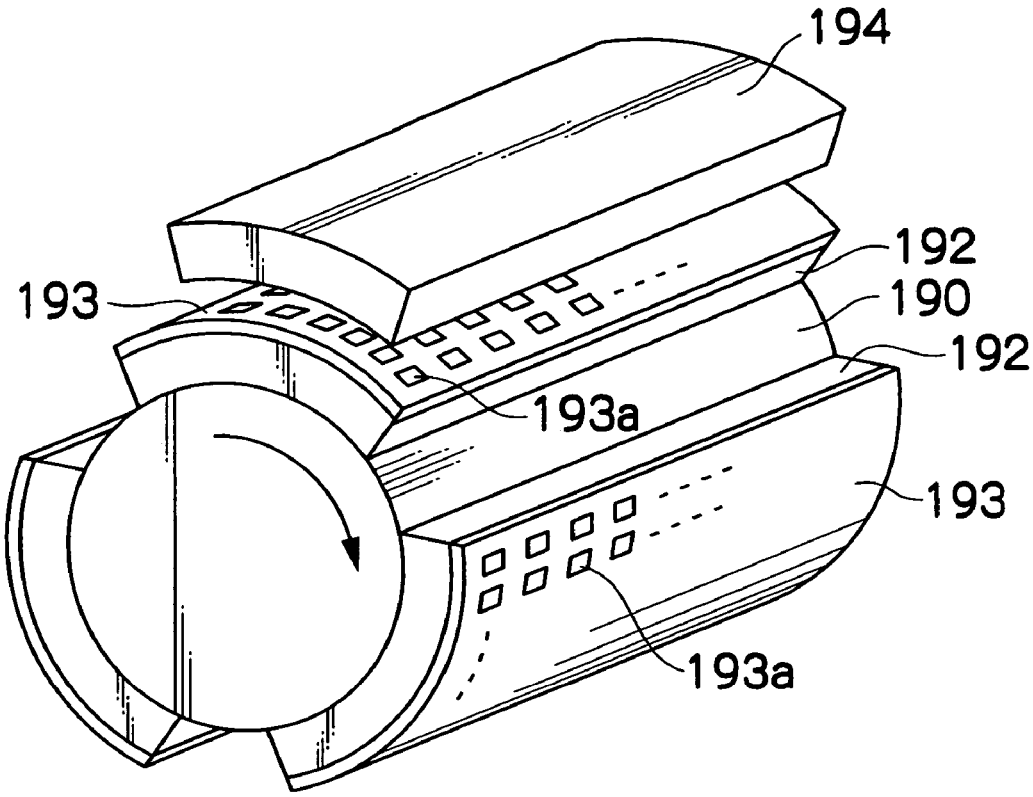
FIG. 13 is an illustrative diagram showing an example of a film formation method for piezoelectric bodies according to an embodiment.

FIG. 13 shows one example of forming films for the piezoelectric bodies 58, by the aerosol deposition method.

In the example shown in FIG. 13, in a chamber for the aerosol deposition, a plate 192 in which the pressure chambers 52 and the diaphragm 56 are bonded is held on the side face of a jig drum 190 of a rotating body; it is then covered with a mask 193 having openings 193*a* corresponding to the shape of the piezoelectric bodies 58; and then micro-particles of a piezoelectric material for forming the piezoelectric bodies 58 are then blown onto the plate 192 from an aerosol deposition spray 194, thereby creating films which form piezoelectric bodies 58, on the plate 192.

In this example, the spray 194 for the aerosol deposition is a long, curved-surface spray, which has the same length as the plate 192 in its lengthwise direction, and is curved similarly to the plate 192 in the breadthways direction (the circumferential direction of the jig drum 190). Therefore, in this case, by keeping the jig drum 190 in a halted state and blowing micro-particles onto the whole surface of the plate 192 from the spray 194 via the mask 193 at a time, it is possible to create the films forming the piezoelectric bodies 58 on the plate 192 in a single operation at a time.

Moreover, by holding a plurality of plates 192 on the jig drum 190, the following operation is possible. More specifically, after the film formation of piezoelectric bodies 58 is completed for one plate 192, by rotating the jig drum 190 by means of a stepping motor, or the like, in such a manner that the next plate 192 arrives at the position of the spray 194, it is possible to form the piezoelectric bodies 58 on the next plate 192 in a single operation at a time.

Figure 14:
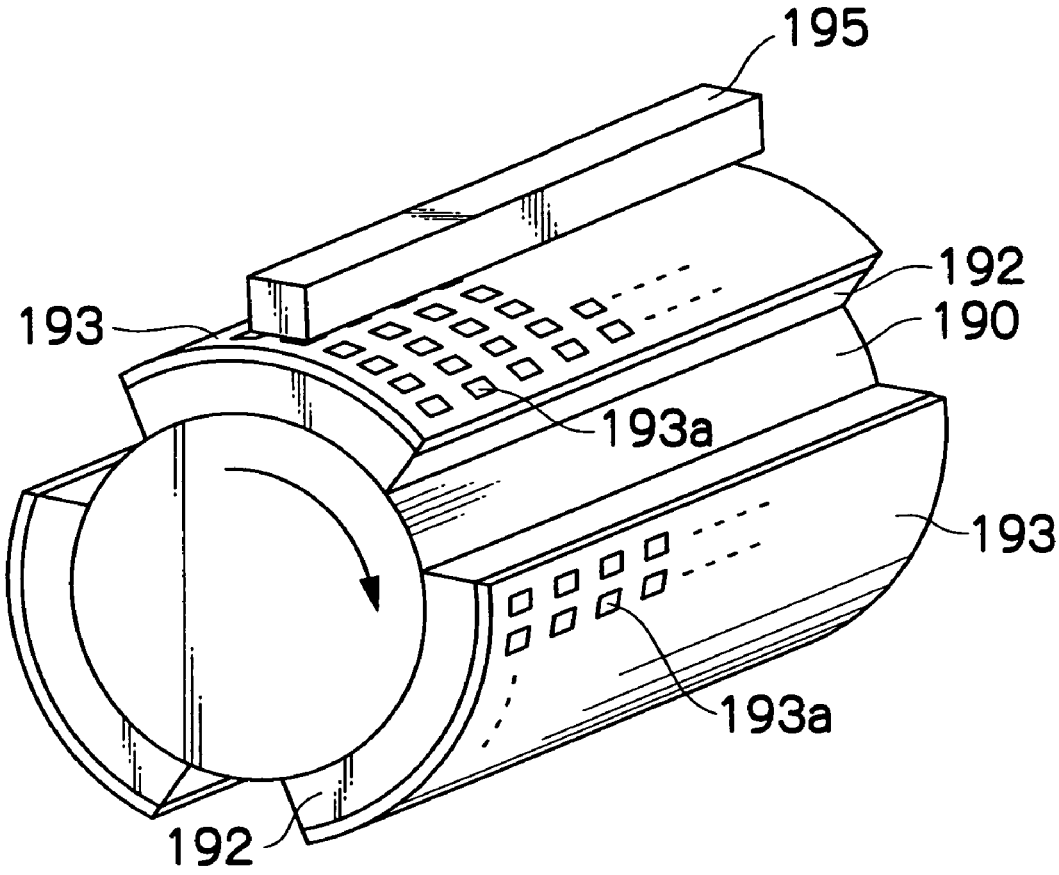
FIG. 14 is an illustrative diagram showing a further example of a film formation method for piezoelectric bodies according to an embodiment.

Furthermore, FIG. 14 shows another example of forming films for the piezoelectric bodies 58 by the aerosol deposition method.

In the example shown in FIG. 14 also, in a chamber for the aerosol deposition, a plate 192 in which the pressure chambers 52 and the diaphragm 56 are bonded is held on the side face of a jig drum 190 of a rotating body; it is then covered with a mask 193 having openings 193*a* corresponding to the shape of the piezoelectric bodies 58; and then micro-particles of a piezoelectric material for forming the piezoelectric bodies 58 are then blown onto the plate 192 from an aerosol deposition spray 195, thereby creating films which form piezoelectric bodies 58, on the plate 192. However, as shown in FIG. 14, in this example, the spray 195 is a line type spray. Therefore, in this case, piezoelectric bodies 58 are formed on the plate 192 in a single operation at a time, by spraying micro-particles through the mask 193 while the jig drum 190 is rotated in a continuous fashion. By forming films while the drum is rotated in this way, it is possible to stabilize the film formation.

Figure 15:
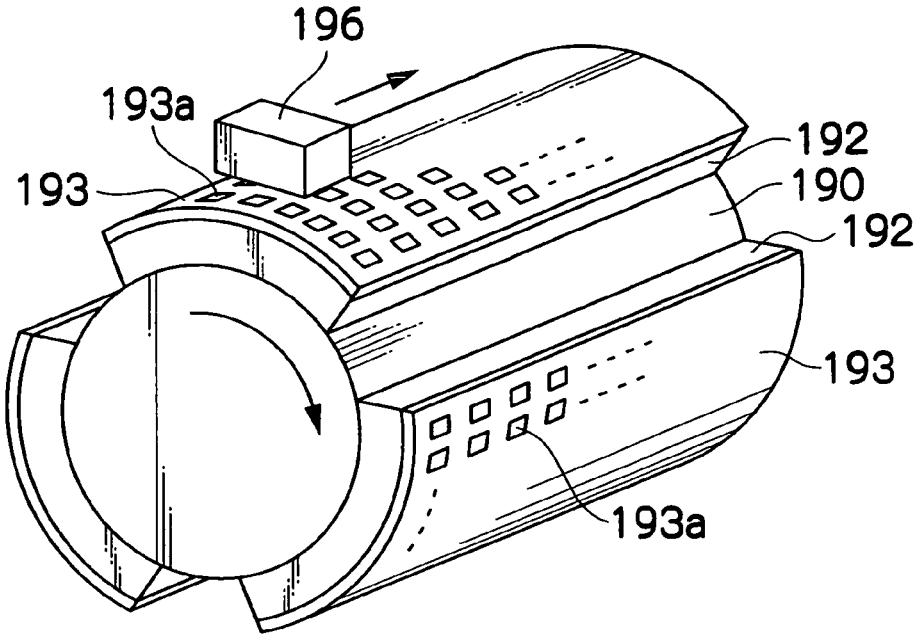
FIG. 15 is an illustrative diagram showing yet a further example of a film formation method for piezoelectric bodies according to an embodiment.

Furthermore, FIG. 15 shows another example of forming films for the piezoelectric bodies 58 by the aerosol deposition method.

In the example shown in FIG. 15 also, in a chamber for the aerosol deposition, a plate 192 in which the pressure chambers 52 and the diaphragm 56 are bonded is held on the side face of a jig drum 190 of a rotating body; it is then covered with a mask 193 having openings 193*a* corresponding to the shape of the piezoelectric bodies 58; and then micro-particles of a piezoelectric material for forming the piezoelectric bodies 58 are then blown onto the plate 192 from an aerosol deposition spray 196, thereby creating films which form piezoelectric bodies 58, on the plate 192. However, as shown in FIG. 15, in this example, the spray 196 is a short type of spray.

More specifically, the spray 196 is shorter than the long, curved-surface spray shown in FIG. 13, in both the circumferential direction and axial direction of the jig drum 190. By causing the spray 196 to scan in the axial direction while the jig drum 190 is rotated (namely, performing spiral scanning in which the rotation of the drum and the linear slide of the spray are combined), piezoelectric bodies 58 are formed on the whole surface of the plate 192, via the mask 193.

By forming the micro-particle spraying surface of the spray 196 so as to have a curved shape in accordance with the plate 192, it is possible to achieve more stable film formation.

The piezoelectric bodies 58 are formed on the diaphragm 56, in a single operation at a time, by means of any one of the methods described above. By creating films to form the piezoelectric bodies in a single aerosol deposition operation in this way, it is possible that the piezoelectric bodies have continuous and uniform properties even if the head is a long head, and furthermore, the piezoelectric bodies can be formed in a highly efficient manner.

Furthermore, since the plate members are bonded by diffusion bonding, then it is also possible to carry out an annealing process with high-temperature heat treatment, in order to improve the properties of the piezoelectric bodies.

Next, at step S150, an individual electrode is formed on each of the piezoelectric bodies 58, by sputtering, for example. In this way, the intermediate layer section including pressure chambers 52, a diaphragm 56, and the like, is formed.

Then, the intermediate layer section and the lower layer section are bonded together by means of an epoxy type adhesive, or the like. At step S160, a sensor plate 64 and a nozzle plate 151 are bonded to the bottom of the pressure chambers 52, by means of a two-liquid type epoxy adhesive, or the like. In the next step, S170, nozzles 51 are formed by multiple-beam processing by an excimer laser, in a nozzle plate 151.

Figure 16:
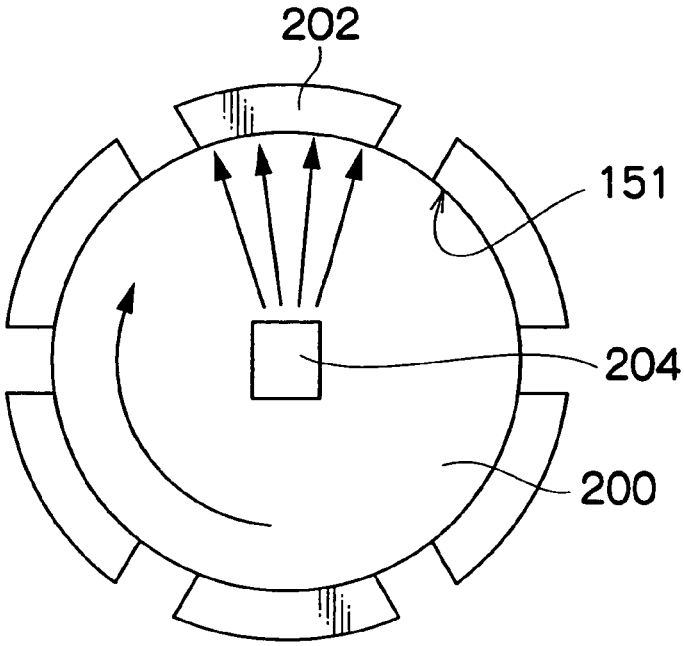
FIG. 16 is an illustrative diagram showing a state of forming nozzle holes by laser processing.

FIG. 16 shows the schematic view of nozzle processing by an excimer layer. As shown in FIG. 16, a laminated plate 202 formed by disposing the nozzle plate 151 below the pressure chambers 52 is held on the circumferential surface of a hollow jig drum 200, with the nozzle plate 151 facing toward the inner side of the jig drum 200.

Multiple beams of an excimer laser are emitted from a laser light source (laser oscillator) 204 fixed at the center of the jig drum 200 while the jig drum 200 is rotated. Thereby, the beams are irradiated onto prescribed positions on the nozzle plate 151 inside the laminated plates 202, after passing through a beam expander, condenser lens, and the like (not shown). Consequently nozzle holes are created in the nozzle plate 151. In this way, the nozzles can be processed perpendicularly by means of a multiple-beam, by creating the nozzle holes after bonding plates in a curved form, and hence the processing quality can be improved.

In the next step, S180, an adhesive is applied to the piezoelectric body cover 68 in the upper layer section. This application of adhesive is performed by transfer application. At the next step S190, the upper layer section and the intermediate layer section are joined by bonding together the piezoelectric body cover 68 of the upper layer section, which has been applied to the adhesive, and the diaphragm 56 of the intermediate layer section.

Next, the electrical columns 60 and sensor columns 66 are formed by respectively inserting plate members 70*a* to form electrical columns 60 and plate members 70*b* to form sensor columns 66, from above, by means of a press, into the holes 60*a* for electrical columns 60 and the holes 66*a* for sensor columns 66 provided in the beam sections 62*a*.

In the final step, S200, a multi-layer flexible printed circuit (FPC) is put and connected on the upper layer section, and thereby the print head 50 is formed.

Figure 17:
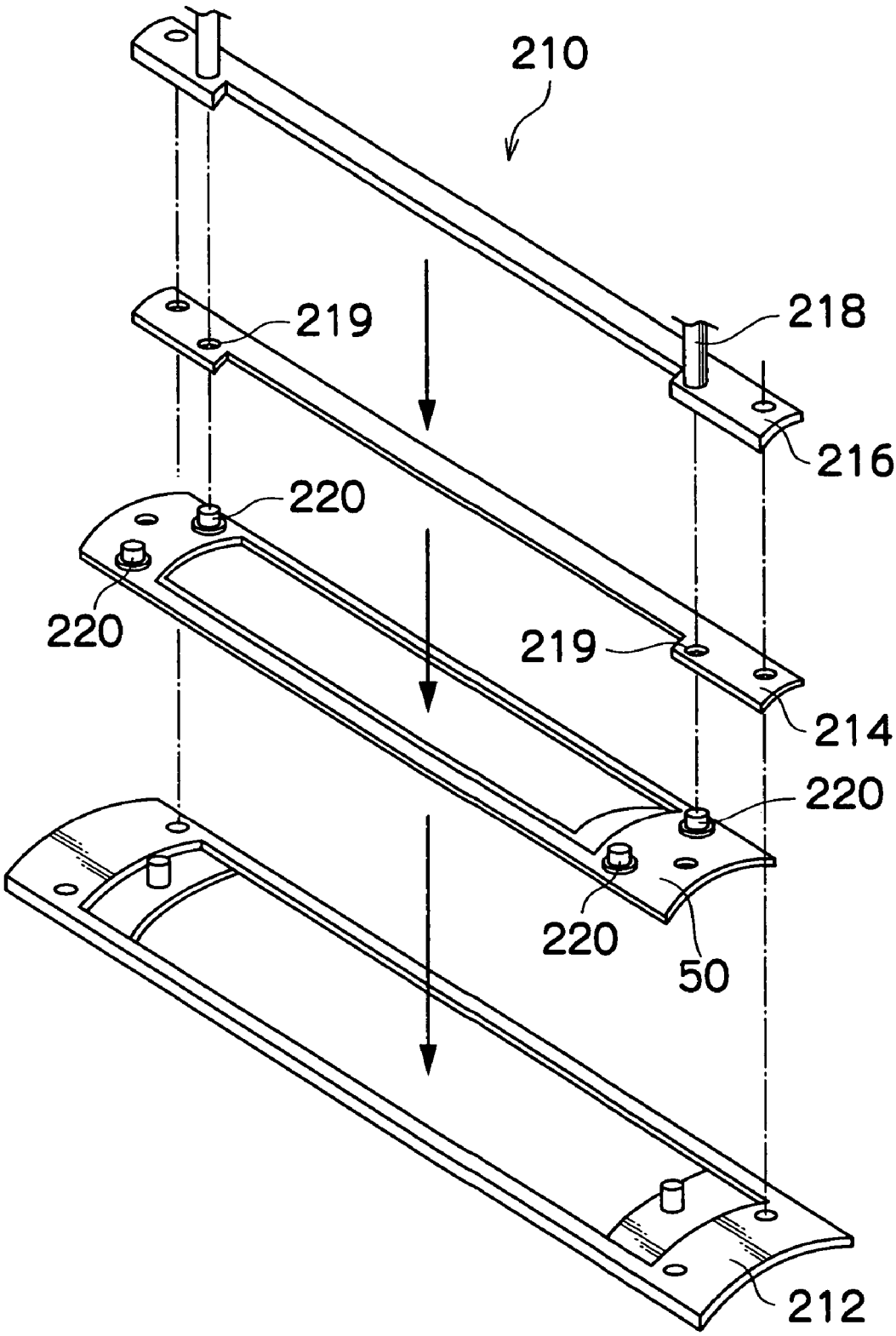
FIG. 17 is an illustrative diagram showing a method for incorporating a print head into an inkjet recording apparatus.

When the print head 50 formed in this way is installed in the inkjet recording apparatus 10, each of head blocks 210 is installed as shown in FIG. 17. In other words, the print head 50 is fitted into a holder 212, then is held between the holder 212 and an attachment 214, and then is fixed to a coupling plate 216. A supply channel 218, which is a supply device for supplying ink to the print head 50, is provided with the coupling plate 216. By fixing the plates in this manner, the main supply port 220 of the print head 50 is coupled with the supply channel 218. Rubber packings 219 for preventing leakage of ink are provided so as to seal the main supply port 220 and the supply channel 218, in the coupling section. Furthermore, although not shown in the drawings, the attachment 214 and the coupling plate 216 are also installed on the near side in FIG. 17 (so that a pair of the attachment 214 and the coupling plate 216, which fits with the main supply ports 220) is provided on the print head 50).

In the embodiment described above, the electrical columns 60 and the sensor columns 66 are formed by inserting the plate member 70*a* to form the electrical columns 60 and the plate member 70*b* to form the sensor columns 66, by means of a pressing operation, but the method is not limited to this.

For example, it is also possible to form the electrical columns 60 and the sensor columns 66 by inserting conductive wires which are to form the electrical columns 60 and the sensor columns 66, respectively, into the holes 60*a* for the electrical columns 60 and the holes 66*a* for sensor columns 66 provided in the beam sections 62*a*. Alternatively, balls provided with a conductive coating (solder plating) may be introduced into the holes 60*a* for the electrical columns 60 and the holes 66*a* for the sensor columns 66 provided in the bean sections 62*a*, and the solder on the surface of the balls may then be melted by irradiating laser light from above, thereby creating electrical connections and thus forming the electrical columns 60 and sensor columns 66.

Next, the operation of the inkjet recording apparatus 10 according to the present embodiment is described.

Firstly, when the power supply of the inkjet recording apparatus 10 is switched off, or when the apparatus is at standby (ready and waiting), the intermediate transfer drum 32 is rotated in such a manner that the print heads 50 (50Y, 50M, 50C, 50K) are situated in a position outside the region of the suctioning section 34 provided on the surface of the intermediate transfer drum 32, and the caps 30 on the print heads 50 (50Y, 50M, 50C, 50K) are then moved downwards in such a manner that the lower ends of the caps 30 make close contact with the surface of the intermediate transfer drum 32.

Thereby, it is possible to prevent drying of the ink meniscus of the nozzles 51 in the print heads 50 (50Y, 50M, 50C, 50K).

Next, the operation in starting up the inkjet recording apparatus 10 in order to make a print or the operation during maintenance of the apparatus, is described.

For example, when the apparatus is started up, there is a possibility that the ink inside the nozzles 51 of the print heads 50 (50Y, 50M, 50C, 50K) may have increased in viscosity during the period when the power supply is switched off, or during standby. Therefore, in order to prevent the occurrence of ejection defects due to ink of raised viscosity, the ink of raised viscosity inside the print heads 50 (50Y, 50M, 50C, 50K) is suctioned, and the nozzle surface 50A is cleaned.

Firstly, the cap 30 which makes tight contact with the surface of the intermediate transfer drum 32 is withdrawn from the intermediate transfer drum 32. Then, the intermediate transfer drum 32 is rotated and the suctioning section 34 is moved to the position of the first print head 50. As shown in FIG. 1, in the present embodiment, the first print head 50 is the print head 50Y which ejects yellow (Y) ink.

When the suctioning section 34 arrives at the position of the print head 50Y, the intermediate transfer drum 32 is halted in this position, the cap 30 of the print head 50Y is lowered, and the lower end of the cap 30 is placed in close contact with the surface of the intermediate transfer drum 32. The ink of increased viscosity inside the print head 50Y is then suctioned out.

Subsequently, the cap 30 of the print head 50Y is withdrawn from the surface of the intermediate transfer drum 32, and the intermediate transfer drum 32 is rotated until the suctioning section 34 arrives at the position of the next print head, 50M. After that, in a similar fashion, the cap 30 of the print head 50M is lowered, and the ink in the print head 50M is suctioned out and sent into the suctioning section 34.

Similarly, the actions of rotating the intermediate transfer drum 32 and suctioning ink are repeated thereafter, so that the ink in all of the print heads 50 (up to and including the print head 50K) has been suctioned.

Subsequently, the wiper 36 is rotated around the axle 36*a* and the front end portion of the wiper 36 is moved to the height of the nozzle surface 50A of the print head 50. The suctioning section 34 is then operated so that ink falling into the suctioning section 34 is suctioned. In addition, the intermediate transfer drum 32 is rotated, thereby cleaning the nozzle surfaces 50A of the print heads 50 (50Y, 50M, 50C, 50K) by means of the wiper 36. The ink on the nozzle surfaces 50A which is wiped off by the wiper 36, falls down and is suctioned and gathered into the suctioning section 34. By performing an ink suctioning operation in this way during the operation of the wiper 36, it is possible to stabilize the wiping operation.

As described above, the intermediate transfer drum 32 is rotated while the wiper 36 is in a raised state, thereby cleaning the nozzle surfaces 50A of the print heads 50. Moreover, when this cleaning has finished, the wiper 36 is withdrawn to its original position.

Next, the operation of the inkjet recording apparatus 10 is described in a case where ejection inspections for the nozzles 51 are carried out.

Firstly, a row of droplets is ejected by the first print head 50Y. Subsequently, this droplet ejection region is moved to the position of the droplet ejection determination sensor 24 by rotating the intermediate transfer drum 32. Next, as shown in FIG. 10, the measurement of the density is carried out by causing the droplet ejection determination sensor 24 to scan in the axial direction of the intermediate transfer drum 32. If, as a result, the non-uniform density is found, then the occurrence of an ejection defect is supposed, and suctioning of the ink in the print head 50 and cleaning (wiping) of the nozzles surfaces 50A are carried out with respect to the ejection defect, as stated previously.

If the determination results relating to the first print head 50Y are good, then the similar inspections are carried out for the next print head 50M. Such inspections are continued similarly thereafter for all of the print heads 50.

Lastly, the operation of the inkjet recording apparatus 10 during the printing is described.

In the printing operation, ink is ejected toward the surface of the intermediate transfer drum 32 from the nozzles 51 while the intermediate transfer drum 32 is rotated, thereby forming a transfer image on the intermediate transfer drum 32. The transfer image is then transferred to a recording medium.

After transferring the transfer image to the recording medium, excess ink remaining on the surface of the intermediate transfer drum 32 is removed by the absorbing roller 40. In this way, liquid droplets, dirt, or other foreign matters on the surface of the intermediate transfer drum 32 is absorbed and removed by the absorbing and removing roller 42, and thereby the intermediate transfer drum 32 is cleaned.

As described above, in the present embodiment, an intermediate transfer drum is combined with an inkjet recording apparatus, and print heads having a two-dimensional matrix structure are disposed at substantially uniform intervals in the axial direction of the intermediate transfer drum, in addition to which the print heads are each formed with a curved surface which curves in accordance with the circumferential direction of the intermediate transfer drum, in the breadthways direction of the print head, thereby ensuring that the gap between each head and the intermediate transfer drum is substantially uniform. Consequently, the ink flight distance is stabilized, and the ink-landing accuracy is improved. Furthermore, since the transfer image is transferred to the recording medium by means of an intermediate transfer drum provided with a fine non-liquid-repelling section which has permeable properties with respect to the ink medium, then it is possible to effectively prevent rotational deviation or landing interference due to skewed travel of the recording medium, or the like.

Figure 18A:
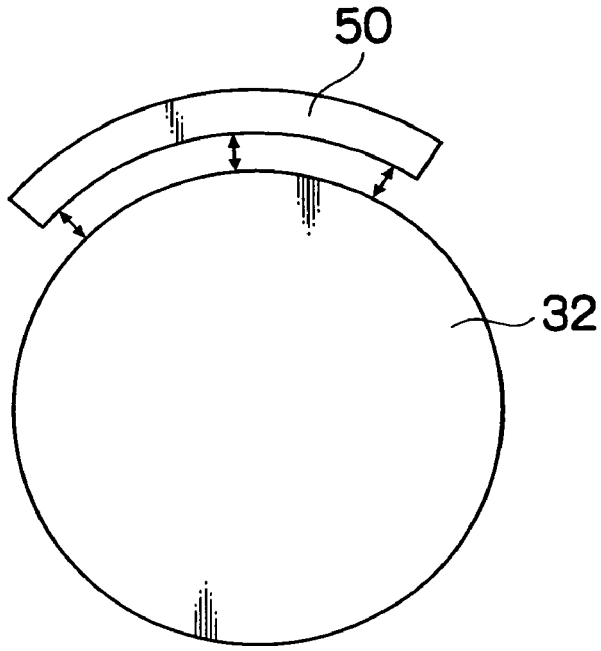
FIGS. 18A and 18B are illustrative diagrams showing the beneficial effects of an embodiment.
Figure 18B:
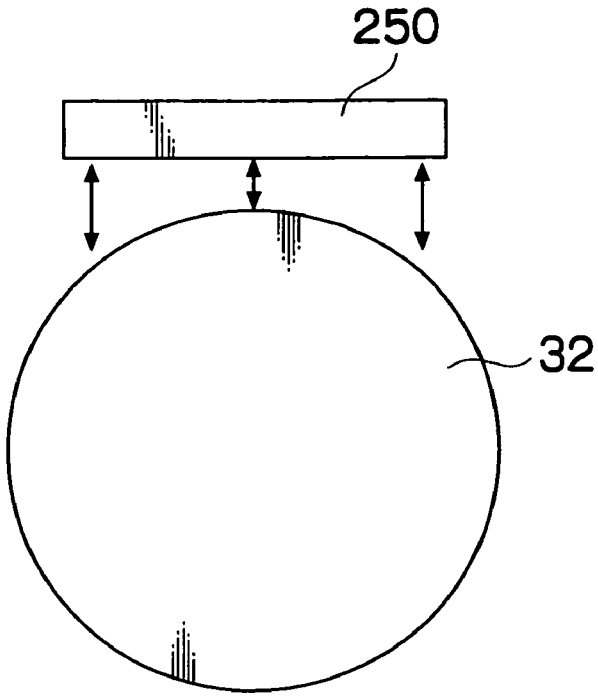

In other words, as shown in FIG. 18A, in the present embodiment, each print head 50 is curved in accordance with the curvature of the circumference of the intermediate transfer drum 32. Therefore, the distance between the nozzles 51 (not shown) of the print head 50 and the surface of the intermediate transfer drum 32 is substantially uniform, and accordingly the accuracy of the ink landing positions is improved. If, by contrast, the print head 250 shown in FIG. 18B has a flat planar shape, then the distance between the head and the surface of intermediate transfer drum 32 varies depending on the nozzle position. Therefore, the ink flight distance may not be stabilized and landing position accuracy may decline.

Furthermore, as stated above, in the present embodiment, while a long two-dimensional matrix type head formed with a curved face is rotated, films for forming piezoelectric bodies are deposited on the head by the aerosol deposition in a single operation at a time. Hence, it is possible to keep good continuity and uniformity of the piezoelectric characteristics even in the case where the head is a long type, and consequently the piezoelectric bodies can be formed in a highly efficient manner. Moreover, the movable-type wiping mechanism and the nozzle suctioning mechanism are provided in the intermediate transfer drum; the movable cap is provided on each print head; the suctioning operation is carried out along with the wiping operation (during the wiping operation); and the droplet ejection determination sensor is provided. Accordingly, it is possible to compactly combine a structure for preventing the nozzles of the print head from drying out during the standby (ready and waiting), a structure for performing the suction actions at the initial filling or in the event of nozzle blockage, a structure for wiping the nozzles for cleaning, and the like. Consequently, a small and highly reliable print system can be achieved.

Furthermore, by performing a suctioning operation in conjunction with the wiping operation, it is possible to gather the ink wiped off, in a stable fashion. Moreover, by determining the droplet ejection, it is possible to carry out reliable maintenance, without wasteful operations. In addition, since the intermediate transfer drum has the permeable property with respect to the ink solvent, the occurrence of bleeding or stickiness on the recording medium is reduced.

In the present embodiment, since the print head is formed with a curved face, the ink supply system, such as the ink flow channels, has a curved shape preferably. Therefore, desirably, the thin plates are arranged together in a curved shape, or the thin plates are formed by molding a resin or metal material, or the like.

Furthermore, recording at even higher density can be achieved by disposing a low-density head movably in the direction (main scanning direction) perpendicular to the conveyance direction; rotating the intermediate transfer drum a plurality of times, thereby recording an intermediate image at high density; and then transferring the image onto the recording medium.

Moreover, if the flight direction of the ink is bent under the effect of gravity by disposing the print head in an inclined fashion, then it is possible to achieve reliable positional correction by disposing the nozzles in positions that are corrected in accordance with the deviation in the landing positions, or by correcting the droplet ejection timings. Additionally, by applying and adjusting an electric field between the drum and the ink, it is possible to stabilize the direction and speed of flight of the liquid even in the case of small droplets, and thus recording with high accuracy in the landing positions is achieved.

Furthermore, it may be possible to adopt a tandem type system where an intermediate transfer drum is provided for each of the print heads.

Figure 19:
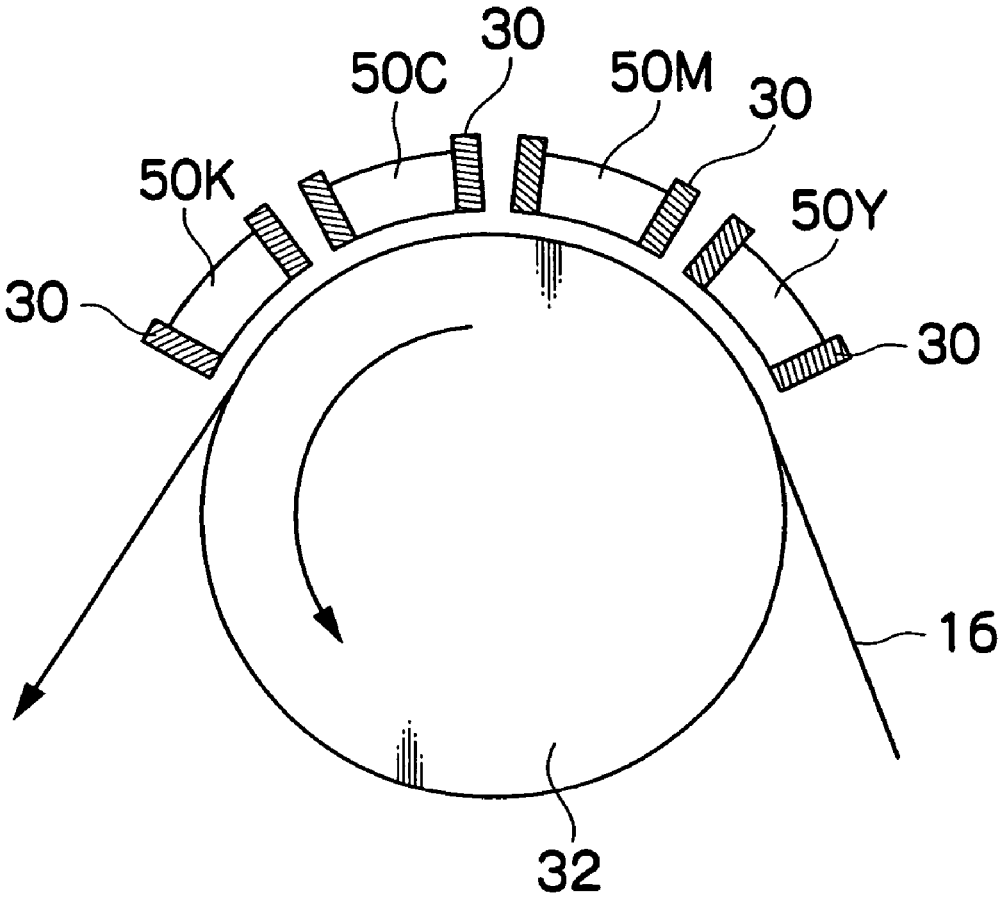
FIG. 19 is a schematic drawing showing an example in which the present invention is applied, in a case where rolled paper is conveyed by being wound about a rotating drum.
Figure 20A:
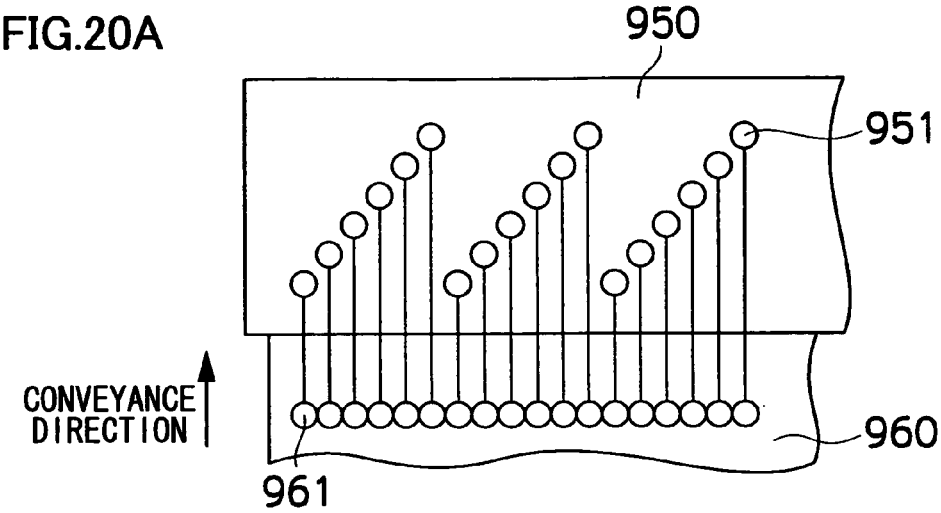
FIGS. 20A to 20C are illustrative diagrams showing possibilities caused by rotational deviation due to skewed travel of the recording medium according to the related art.
Figure 20B:
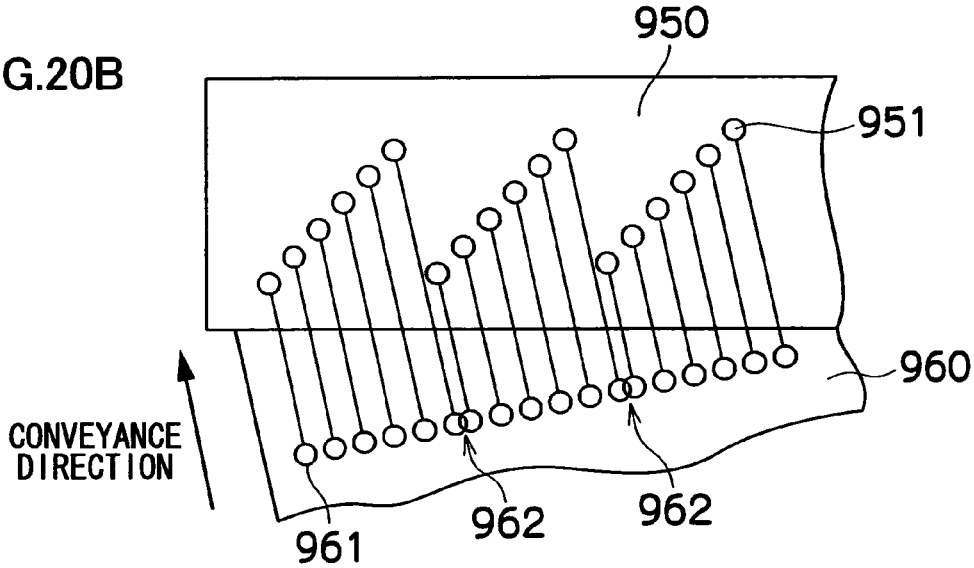
Figure 20C:
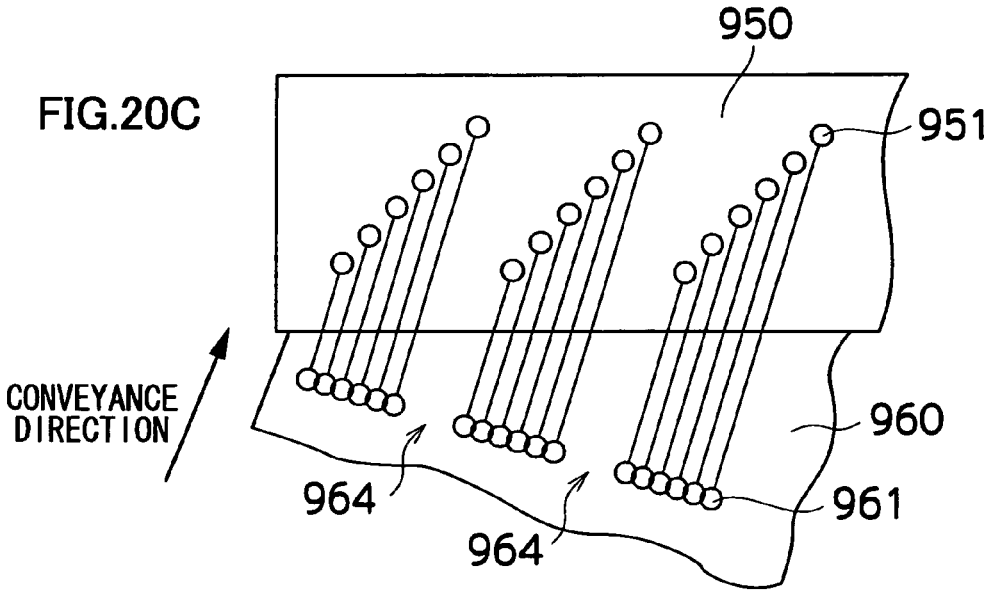

Moreover, the present invention is not limited to using an intermediate transfer drum as described above, and it can also be applied suitably to a system such as that shown in FIG. 19, where recording paper 16 in the form of a roll is conveyed in a wound state on a rotating drum 32, and images are recorded by ejecting ink onto the recording paper 16 from the print heads 50 (50Y, 50M, 50C, 50K) disposed following the circumferential direction (circumference) of the rotating drum 32.

The image forming apparatus according to the present invention has been described in detail above, but the present invention is not limited to the aforementioned embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing a liquid ejection head, comprising the steps of:

forming an entire first substrate into a curved shape so as to form a portion of a substantially cylindrical shape, the first substrate being provided with a liquid flow channel of liquid and a drive wire for supplying a drive signal to a piezoelectric element;

forming an entire second substrate into a curved shape so as to form a portion of a substantially cylindrical shape, the second substrate forming a pressure generating chamber for ejecting the liquid and a diaphragm which forms a surface of the pressure generating chamber;

forming the piezoelectric element on the diaphragm at a position corresponding to the pressure generating chamber;

forming an ejection port plate on an opposite side across the pressure generating chamber from the diaphragm; and bonding together the first substrate and the second substrate.

2. The method as defined in claim 1, wherein:

the first substrate includes a plurality of third substrates; and at least one pair of the third substrates is formed by diffusion bonding.

3. The method as defined in claim 1, wherein:

the second substrate includes a plurality of fourth substrates; and at least a portion of the fourth substrates is formed by diffusion bonding.

4. The method as defined in claim 1, wherein at least a portion of the piezoelectric element is formed as a film by an aerosol deposition method.

5. The method as defined in claim 4, wherein film formation of the piezoelectric element by the aerosol deposition method is performed by rotating aerosol spray nozzles included in a nozzle surface having a curved shape.

6. The method as defined in claim 4, wherein film formation of the piezoelectric element by the aerosol deposition method is performed by rotating the second substrate containing the diaphragm.

7. The method as defined in claim 1, further comprising the step of forming an ejection port in the ejection port plate by laser processing after the step of forming the ejection port plate.

8. The method as defined in claim 1, wherein each of the first and second substrates has the curved shape which has lengthwise sides parallel with an axis of the substantially cylindrical shape, and widthwise sides curved along a circumference of the substantially cylindrical shape.

* * * * *